US005961094A

United States Patent [19]

Van Winkle

[11] Patent Number: 5,961,094

[45] Date of Patent: Oct. 5, 1999

[54] METHOD AND APPARATUS FOR REPLACING A PACKER ELEMENT

[75] Inventor: Denzal Wayne Van Winkle, Santa Maria, Calif.

[73] Assignee: Tuboscope I/P Inc.

[21] Appl. No.: 09/103,917

[22] Filed: Jun. 24, 1998

[51] Int. Cl.[6] ..... E21B 33/06

[52] U.S. Cl. ..... 251/1.1; 166/277

[58] Field of Search ..... 251/1.1, 1.3; 106/360, 106/365, 277

[56] References Cited

U.S. PATENT DOCUMENTS 3,741,296 6/1973 Murman et al. ..... 166/0.6
4,007,905 2/1977 Mott ..... 251/1 R
4,133,342 1/1979 Carnahan ..... 166/277
5,590,867 1/1997 Van Winkle ..... 251/1.3

*Primary Examiner*—John Fox
*Attorney, Agent, or Firm*—Gunn & Associates, P.C.

[57] ABSTRACT

A method and a device for replacing a seal element in an undersea blowout preventer is provided. A complete system includes a control center on the surface, an umbilical from the control center to a remotely operated vehicle (ROV), and a seal element carrier manipulated by the ROV. The carrier includes either retrieving tool or a running tool, which retains a cartridge which is to be inserted into or has been retrieved from a BOP. The cartridge is split along a vertical plane, with each half of the cartridge becoming a temporarily integral part of a pipe ram on either side of the BOP. Alignment ramps on the cartridge mate with complementary surfaces on the respective faces of the pipe rams.

13 Claims, 24 Drawing Sheets

10
12
14
16
17
18
20

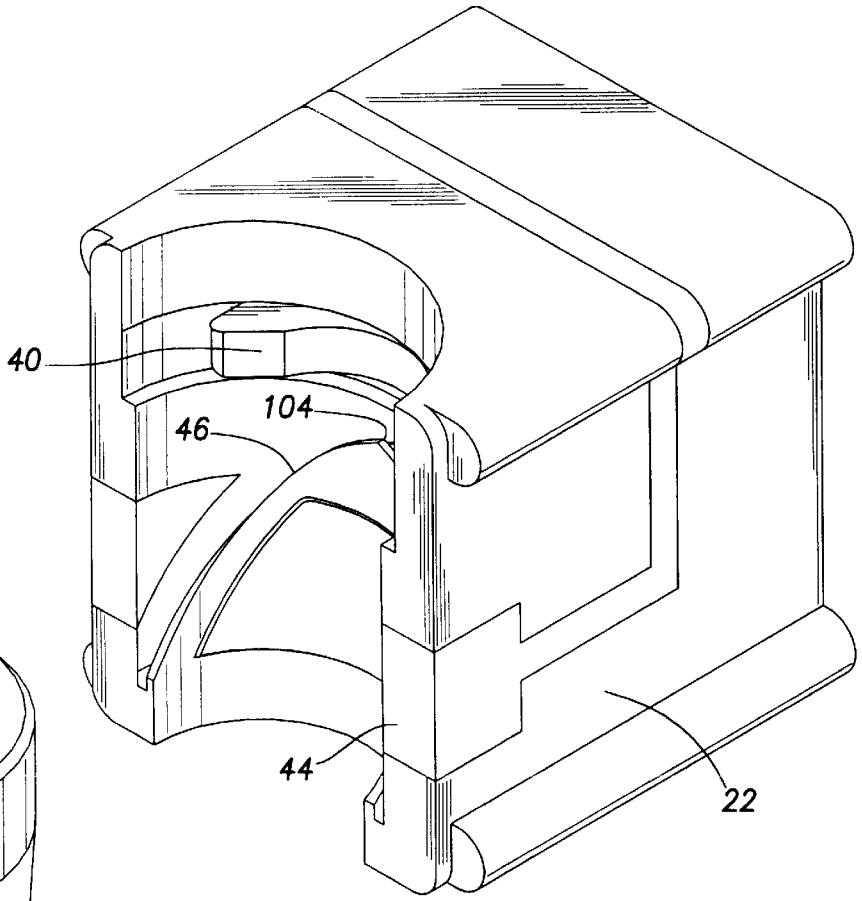
FIG.d
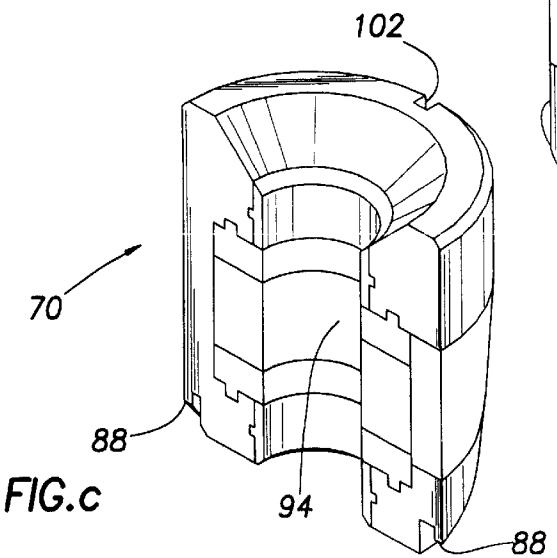
FIG.c

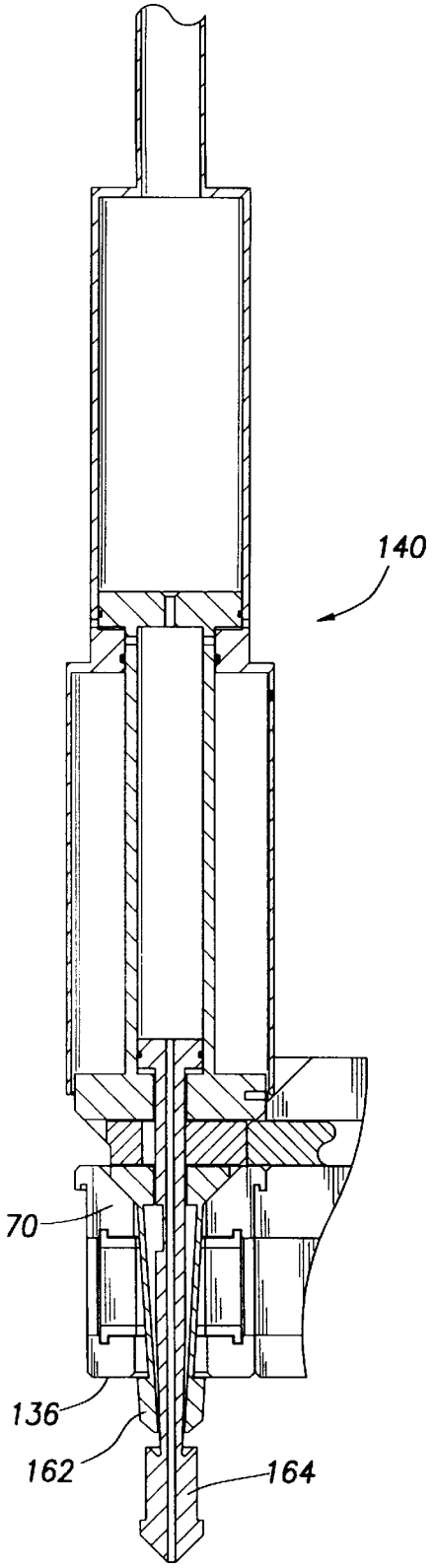
FIG.7d
FIG.7e
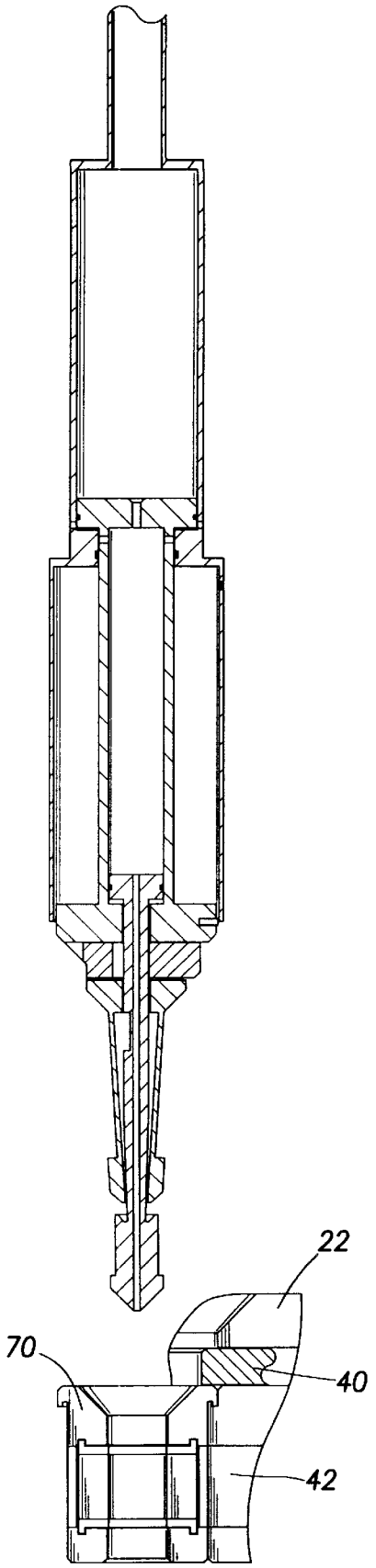

FIG.8a1
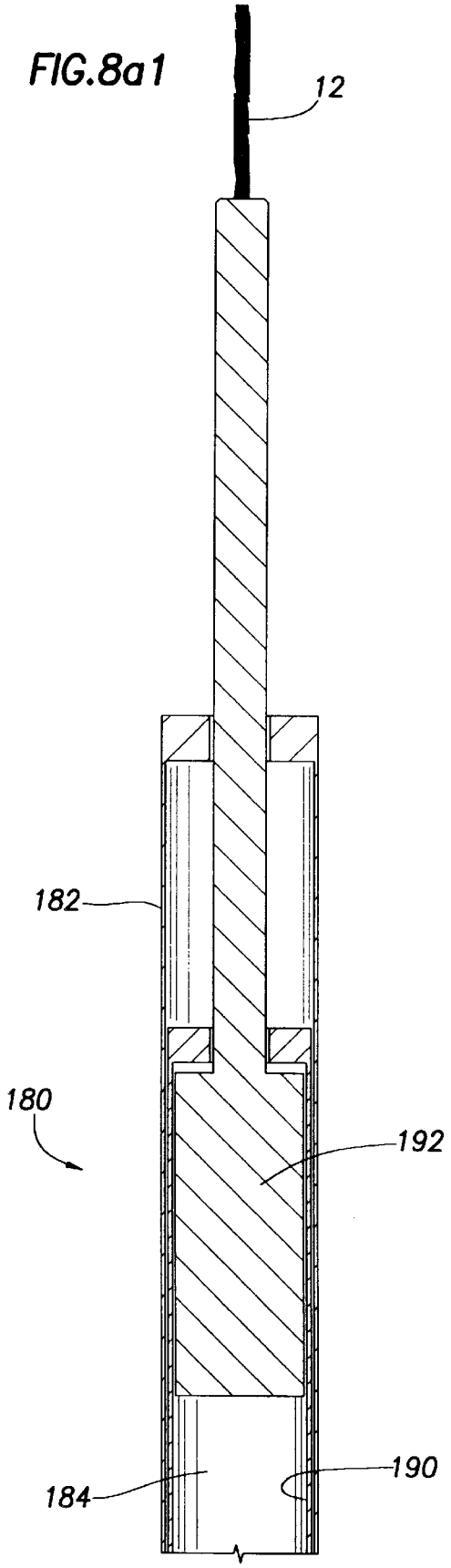
FIG.8a2
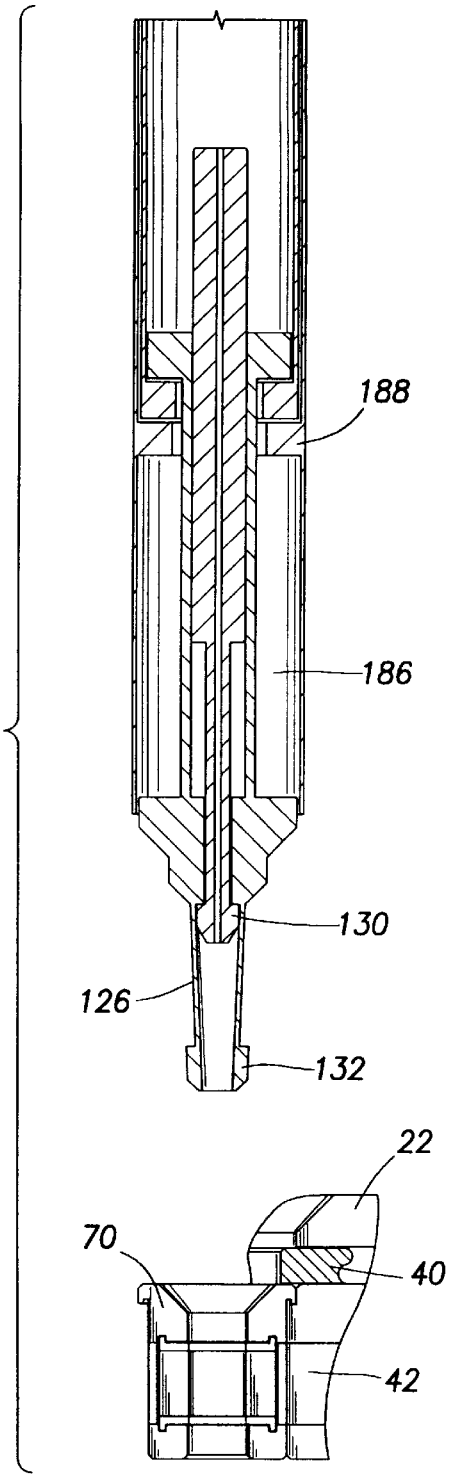

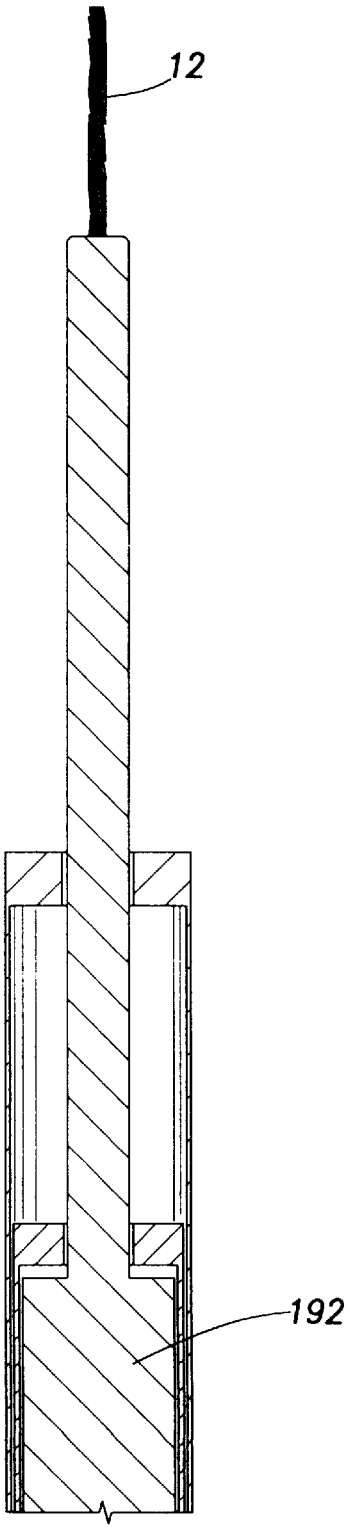
FIG.8b1
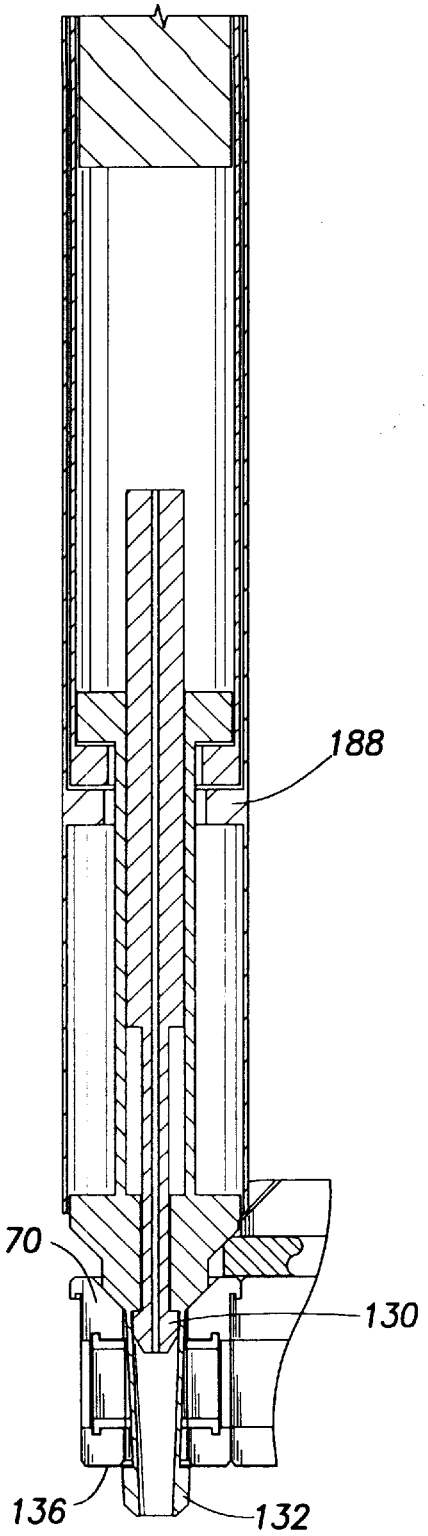
FIG.8b2

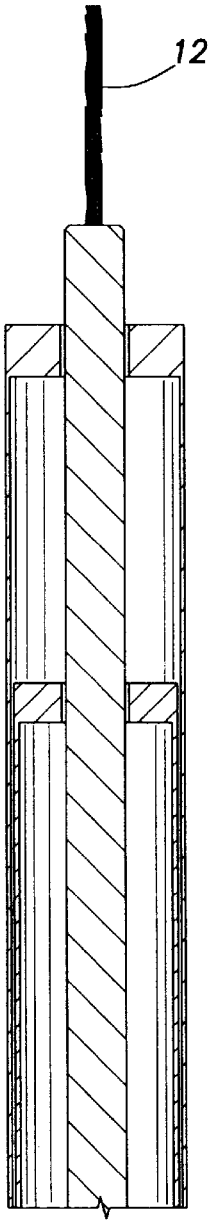
FIG.8c1
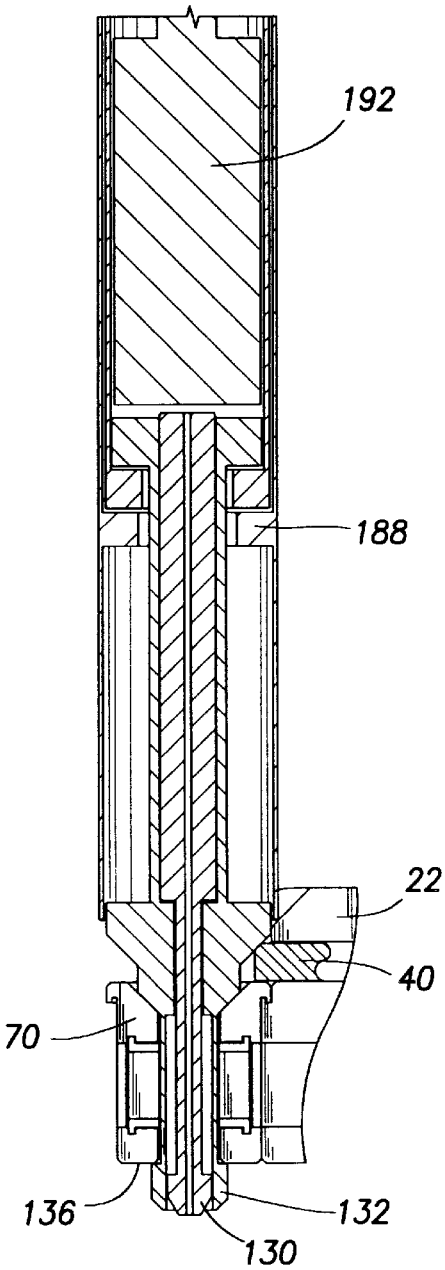
FIG.8c2

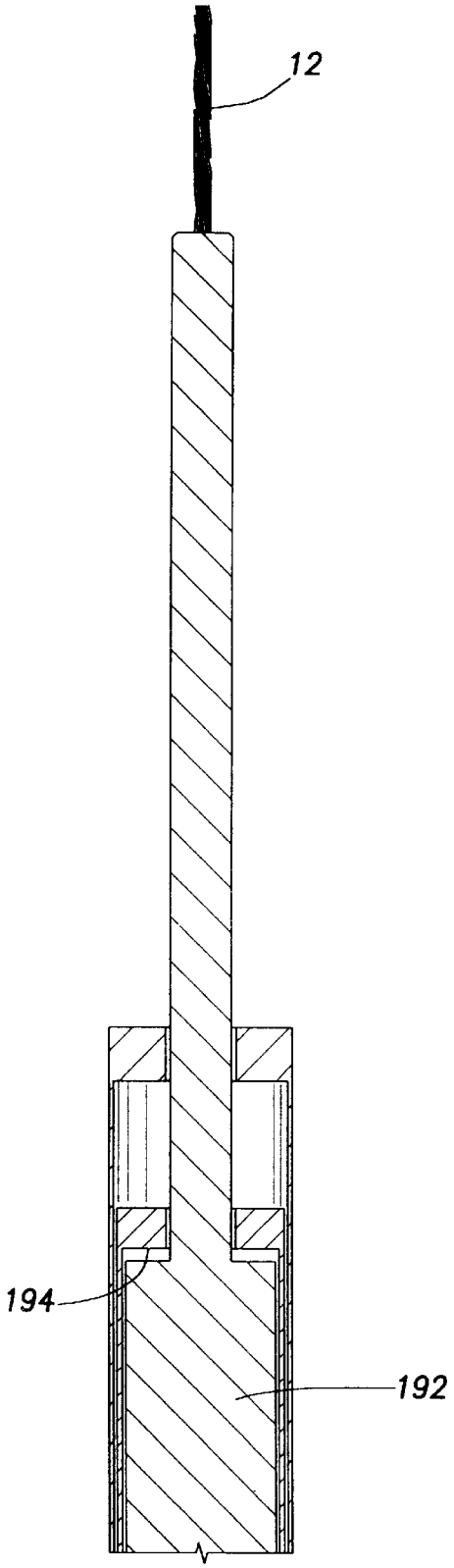
FIG.8d1
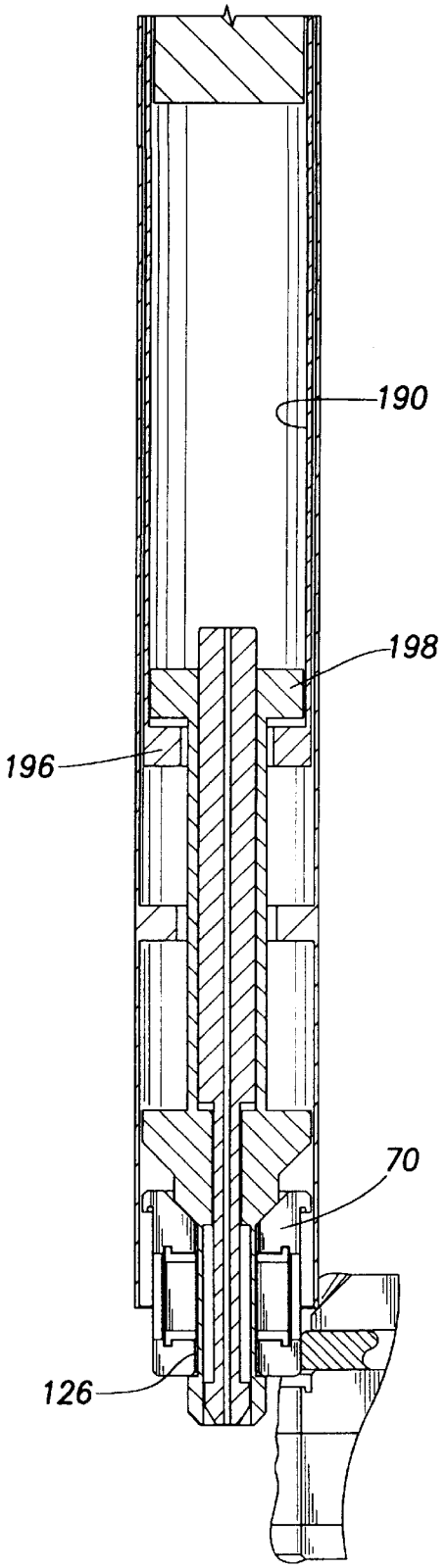
FIG.8d2

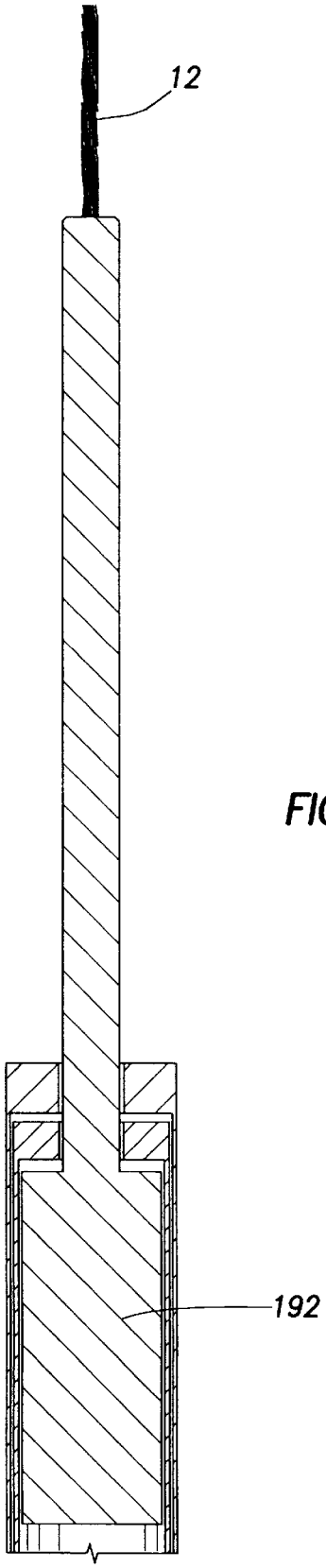
FIG.8e1
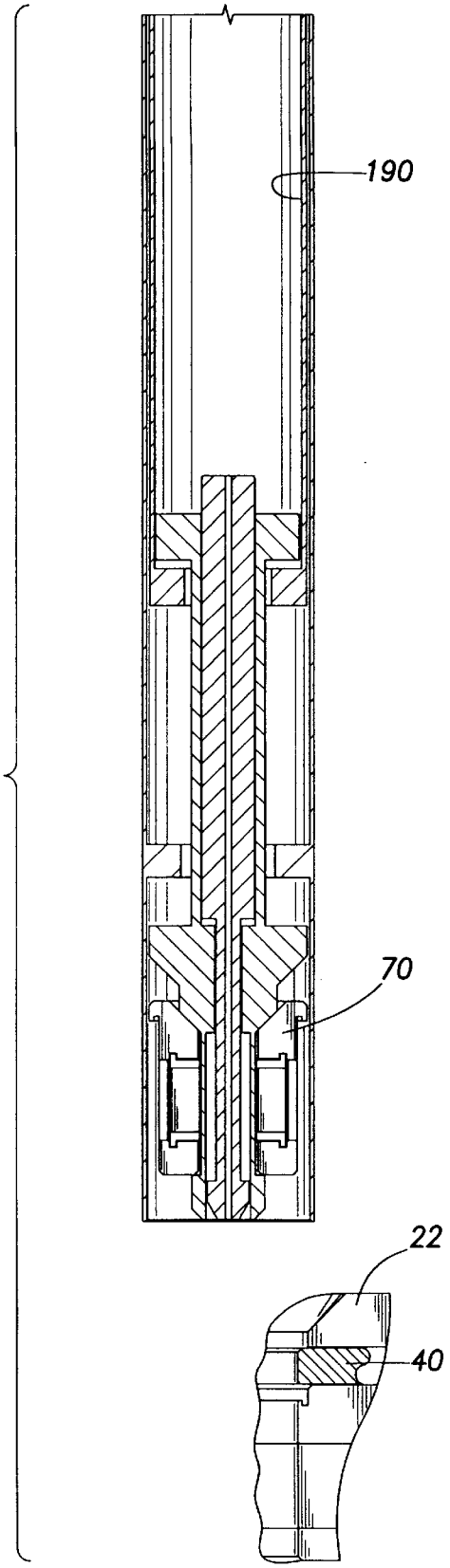
FIG.8e2

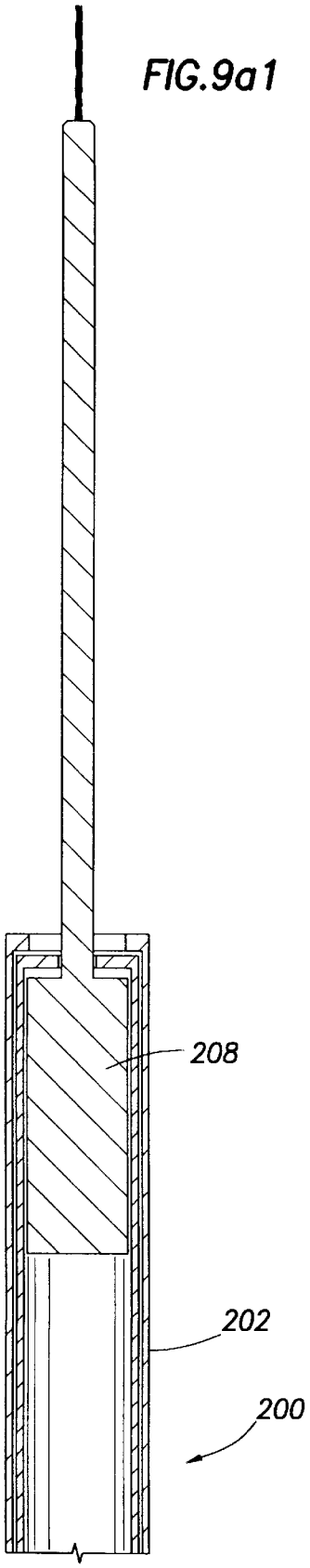
FIG.9a1
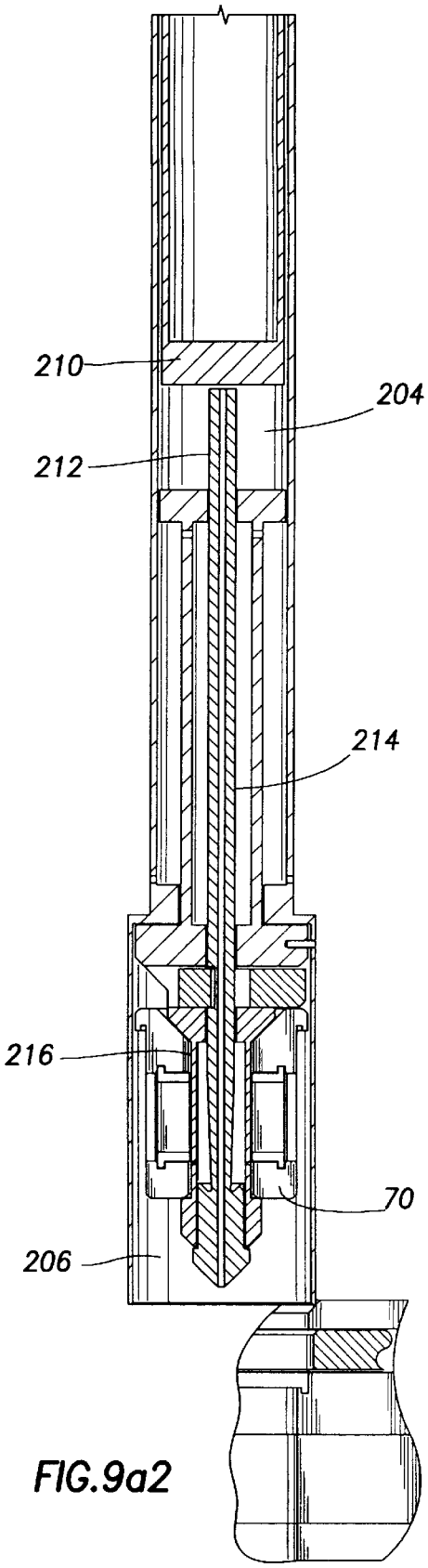
FIG.9a2

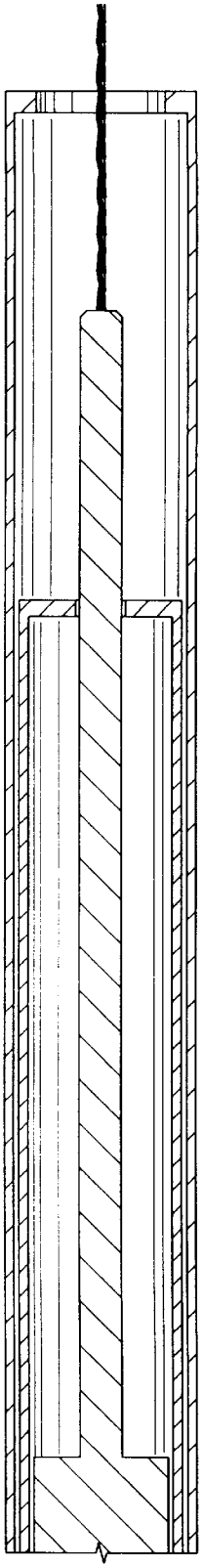
FIG.9b1
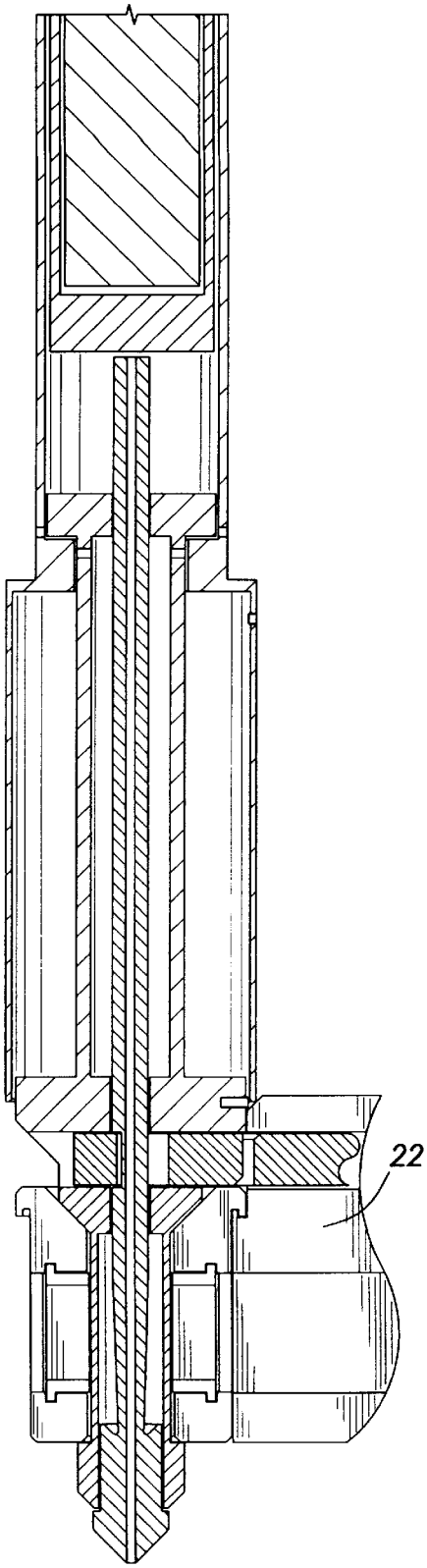
FIG.9b2

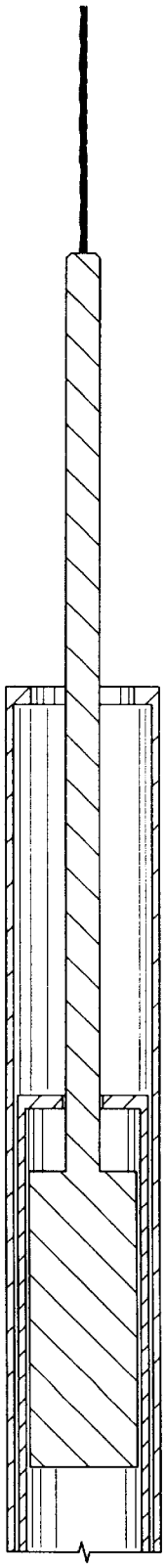
FIG.9c1
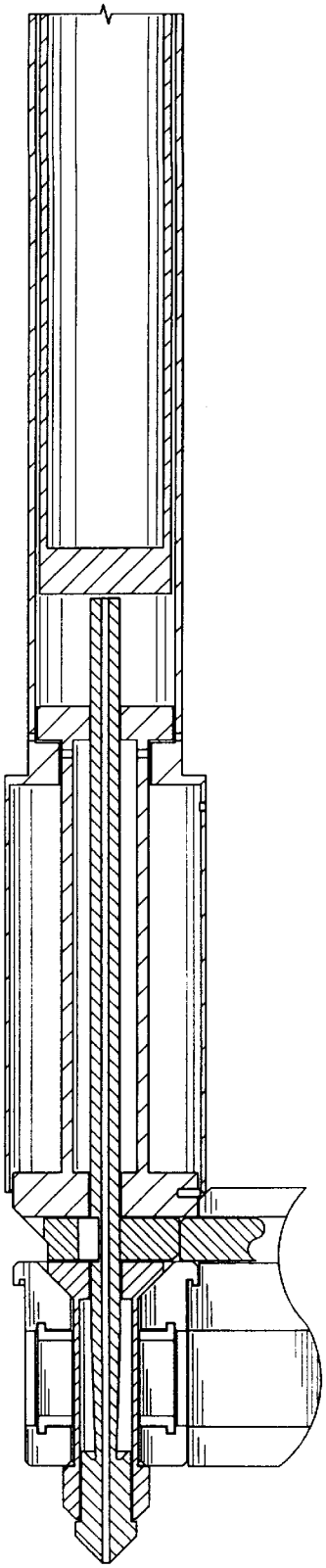
FIG.9c2

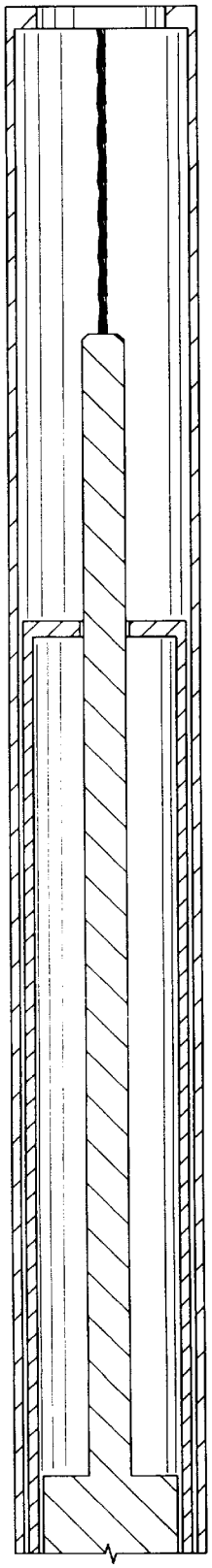
FIG.9d1
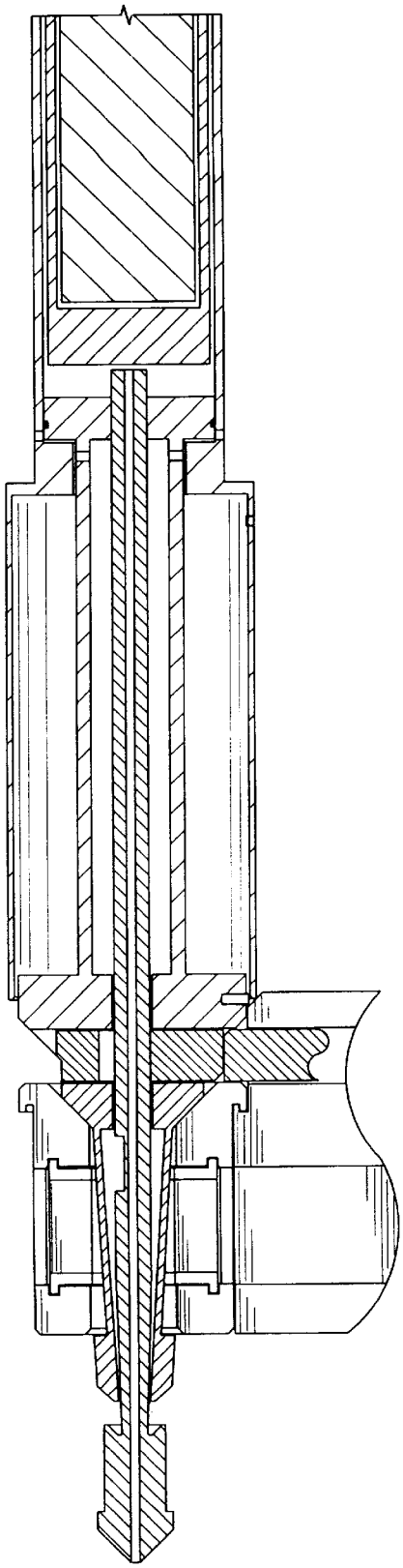
FIG.9d2

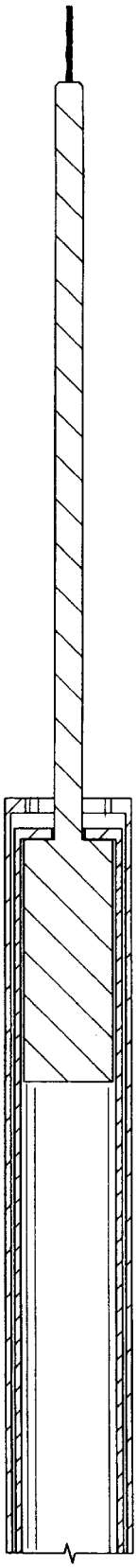
FIG.9e1
FIG.9e2
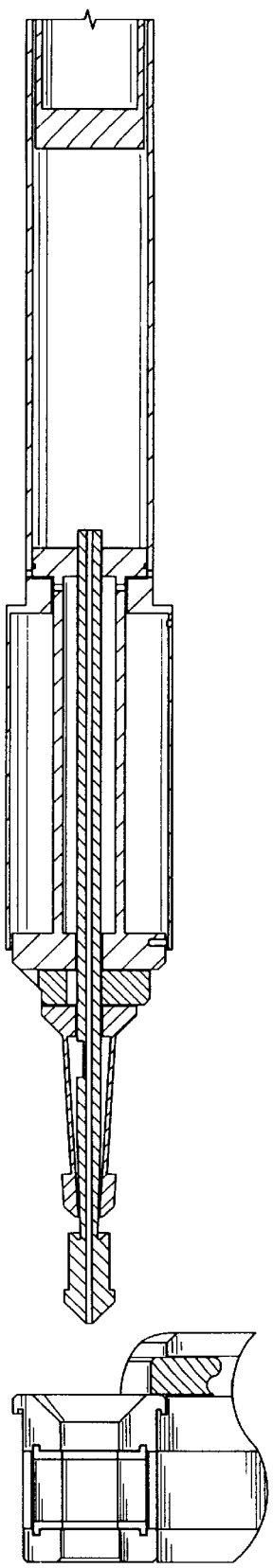

METHOD AND APPARATUS FOR REPLACING A PACKER ELEMENT

FIELD OF THE INVENTION

The present invention relates generally to the field of blowout preventers and, more particularly, to a device and a method to replace a worn packer element in a BOP or stripper in an application without human access to the BOP, such as sub-sea areas.

BACKGROUND OF THE INVENTION

Proposed drilling and work-over operations with well heads installed under water make it desirable to perform specific repair and maintenance evolutions without bringing either a worn stripper element or an entire blowout preventer (BOP) to the surface. Current methods below safe depths for diver operations require bringing the BOP component to the surface for refurbishment. Such an operation is expensive, time consuming, and results in significant down time for the well being maintained.

Shallower operations may be performed by a diver, but as drilling operations take place at ever increasing depths, such techniques become impractical. The following disclosure facilitates replacement of worn packer sealing elements, and/or replacement of such an element with a different size or having a different function, such as changing from a packer to a slip element. Further, these functions are performed without the aid of a diver.

This invention provides a method of installing and removing a cartridge having a wear element on it. Thus, a wear element to be replaced may be replaced with a new element of the same size and type, or of either a different size and or a different function. That is, a packer can be replaced with a fresh seal and or wear bushings of the same or a different size. The cartridge is installed and/or removed using a coiled tubing work string, a wireline, or drill pie.

SUMMARY OF THE INVENTION

The present invention addresses these and other drawbacks of the prior art by providing a system for replacing sealing elements in a BOP remotely without the aid of a diver. The overall system comprises a control station on the surface, a remotely operated vehicle (ROV) handling a tool with the sealing element (, and an umbilical between them. The ROV is necessary unless there is already a continuous conduit from the BOP to the surface. The control station on the surface provides commands to the ROV through the umbilical. The ROV manipulates a cylindrical carrier which includes either a retrieving tool or a running tool. The tool provides a means of retaining a cartridge within the carrier and the cartridge includes a packer or a slip element. The running tool delivers the cartridge with the new sealing element to the BOP, which is adapted to receive the cartridge. The retrieving tool drives into the cartridge within the BOP and extracts the cartridge. The cartridge may then be delivered to the surface and a replacement of the same type and size of sealing element, or of a different type and/or size, may then be delivered to the BOP by a running tool.

In another aspect of this invention, a cartridge carrying a packer element which may be installed and removed remotely without the aid of a diver is provided. The packer cartridge is split vertically into two approximately symmetrical halves and the split cartridge is carried on a running tool or a retrieving tool, which tools are features of this invention. A split cartridge may fall off any current design of a running tool when the packer cartridge is raised into the region above the stripper or blowout preventer, so the present invention further provides a running tool and a retrieving tool, each of which serves as a carrier for the cartridge.

Since in normal operations, conduit from a well head on the sea floor may not be continuous back to the working platform on the surface, the running and retrieving tools with a cartridge contained therein are designed to be transported while open to sea water.

In still another aspect of the present invention, a BOP to receive a cartridge including a new sealing element is provided. A cartridge including a replacement packer or slip element requires precise rotational orientation for installation. That is, each half of the cartridge with its associated sealing element must align with its designated ram or packer component. Consequently, the present invention provides alignment ramps defining helical downwardly facing flanges on the exterior surface of the cartridge that automatically align the cartridge with the BOP. This feature of this invention provides a means of automatically orienting the new replacement element in the BOP.

The cartridge and carrier are also provided with means to retain the cartridge within the carrier in order to avoid dropping the cartridge as it is moved to and from the BOP at the sea floor. Once the cartridge halves are in place, they must be locked into each ram with something other than known methods, such as expanding locks held open by a continuous ring.

In yet another aspect of this invention, an improved blowout preventer provides means for accommodating a cartridge which includes a packer element. The rams of the BOP must close to a specific position to accept the cartridge, but no force to actuate the packer can be applied when the cartridge in initially installed in the BOP. The cartridge locates on a no-go shoulder at a specific position which accommodates all downward bearing loads. The BOP as disclosed herein has a separate locking function to restrain all upward forces on the cartridge, maintaining it in the described location. While maintaining the closed position of the rams, a separate force must be applied to energize the packer within the cartridge. In the present invention, the BOP is provided with a locking means to maintain the position of the packer carrier while additional pack-off force is applied by means of a coaxial piston.

These and other features of the present invention will be apparent to those of skill in the art from a review of the following detailed description along with the accompanying drawings.

BRIEF DESCRIPTION OF THE DRAWINGS

FIGS. 5*b* and 5*c* are perspective views of the support portion of a split cartridge of this invention with its packer element in place.

FIG. 5*d* is a perspective view of a ram adapted to receive a cartridge of FIGS. 5*a* through 5*c*.

FIGS. 7*a* through 7*e* depict a running tool and a preferred sequence of operations in running in a replacement BOP packer or slip element where the running tool is run on a pressure conduit such as coiled tubing or drill pipe.

FIGS. 8*a* through 8*e* depict a retrieving tool of this invention as run in on a wireline umbilical and a preferred sequence of operations in retrieving a cartridge from a BOP using this tool.

FIGS. 9*a* through 9*e* depict a running tool as run in on a wireline umbilical and a preferred sequence of operations in running in a replacement cartridge into a BOP using this tool.

DETAILED DESCRIPTION OF A PREFERRED EMBODIMENT

Figure 1:
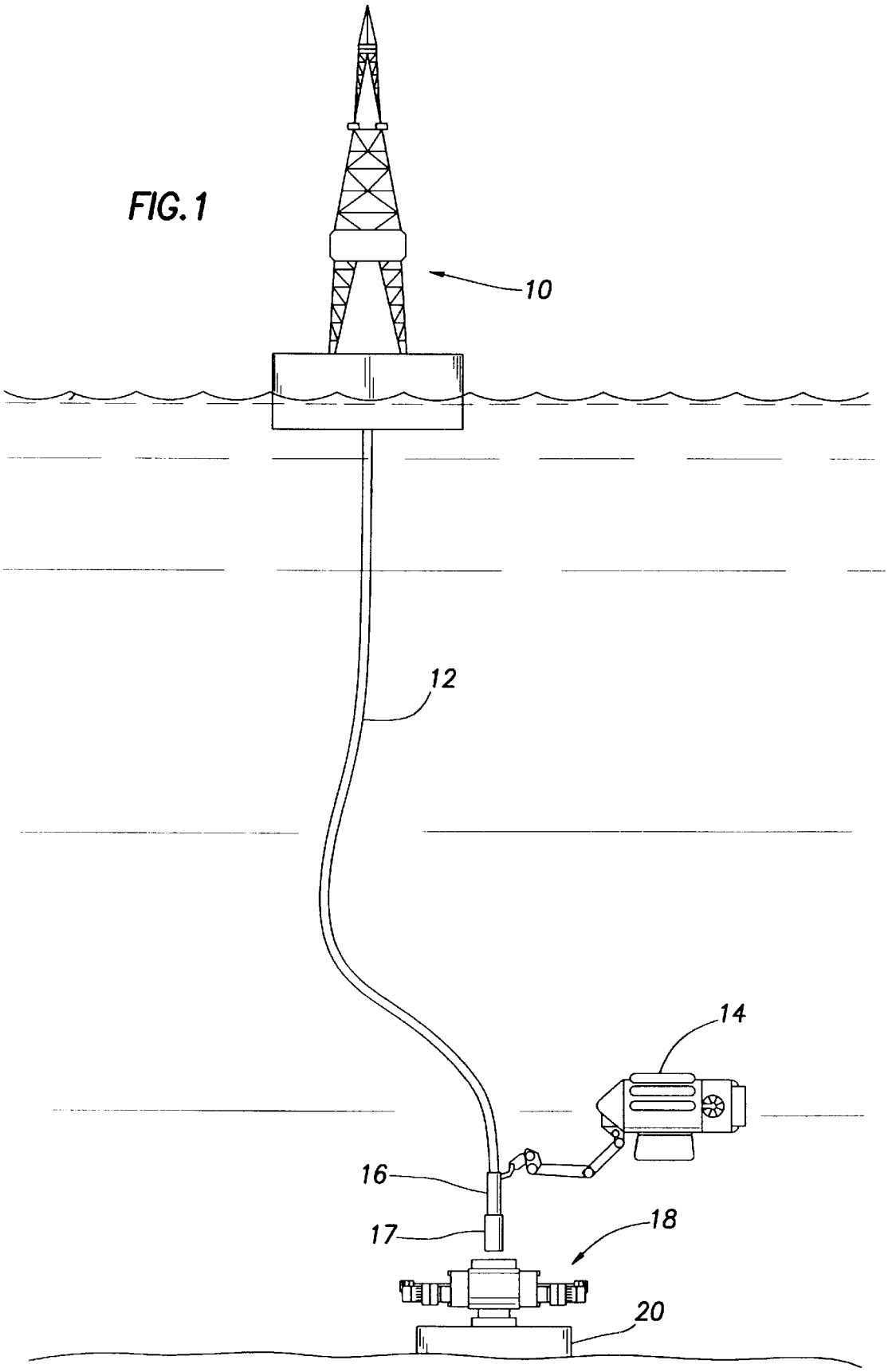
FIG. 1 is an elevation view of a complete system for remotely replacing a packer element while employing the present invention.

FIG. 1 depicts a system for replacing a packer element using the method and device of the present invention. The system comprises primarily a surface platform 10 from which the evolution is conducted, a communications umbilical 12, a remotely operated vehicle 14, and a carrier 16, which encloses either a running tool or an retrieving tool within a protective cylinder 17, which is open at the bottom, and thus the sea, for easy access to a BOP 18. Also included within the protective cylinder is a cartridge for the packer or slip element retained by the running tool or the retrieving tool, all of which are described below in greater detail.

In operation, a packer element in a cartridge carried by the carrier 16 is brought to or extracted from the BOP 18 at a well head 20. The carrier is directed in these operations by the remotely operated vehicle 14 through the umbilical 12 as controlled by an operator on the surface platform. The umbilical may preferably be coiled tubing, wireline, or drill pipe.

Figure 2:
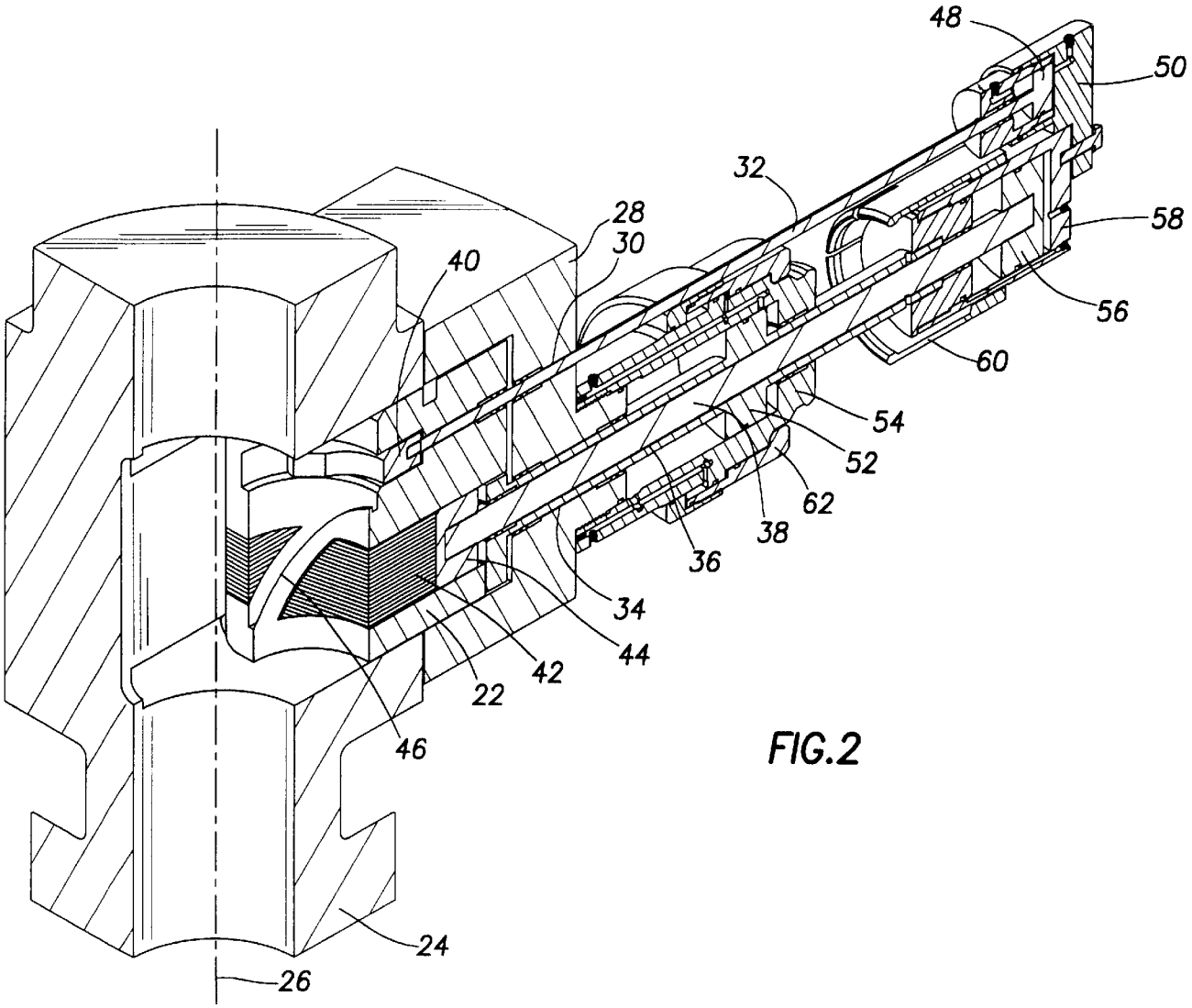
FIG. 2 is a cutaway perspective view of a blowout preventer adapted to employ the present invention
Figure 3:
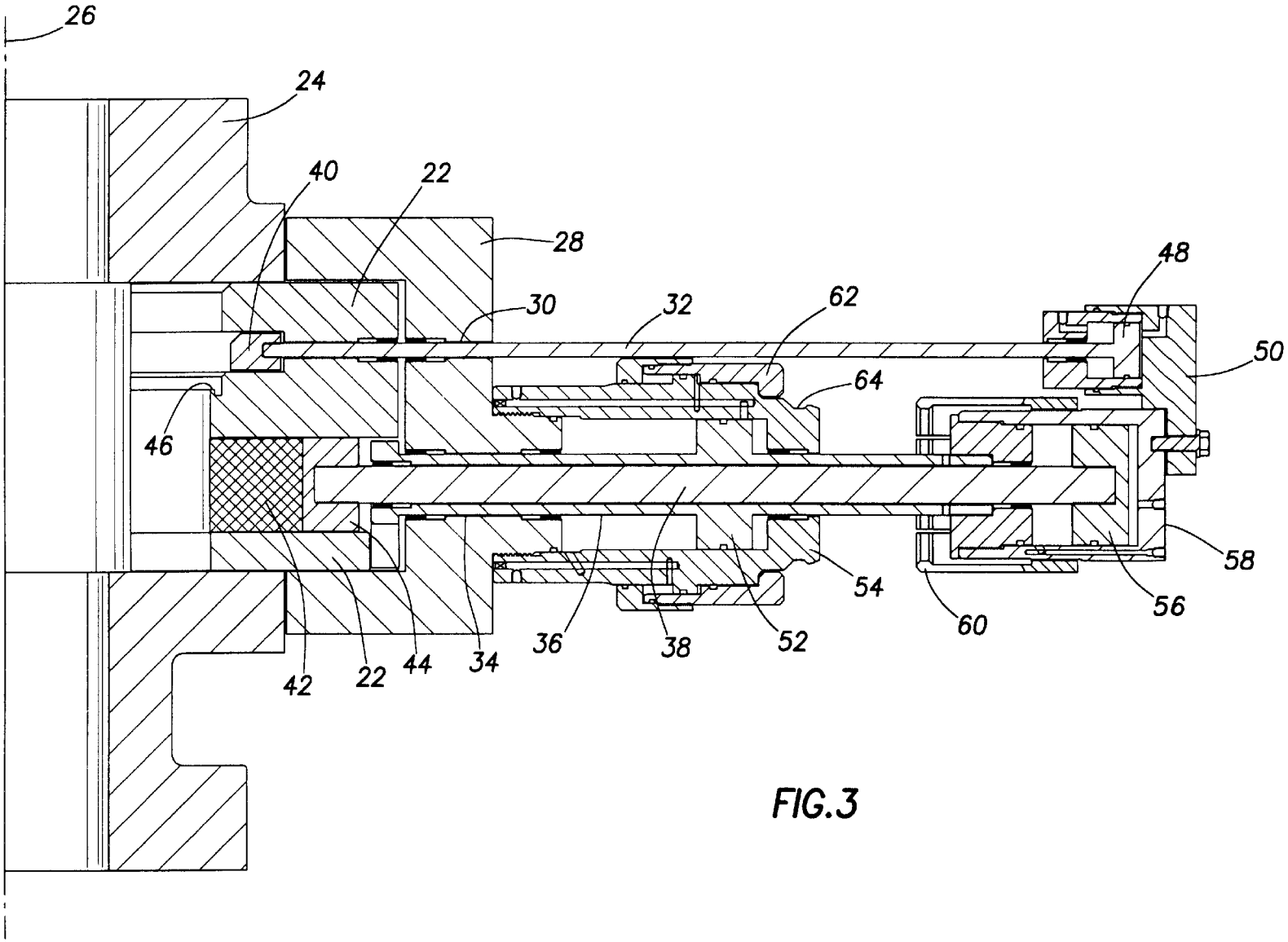
FIG. 3 is a side section view of the BOP of FIG. 2.
Figure 4:
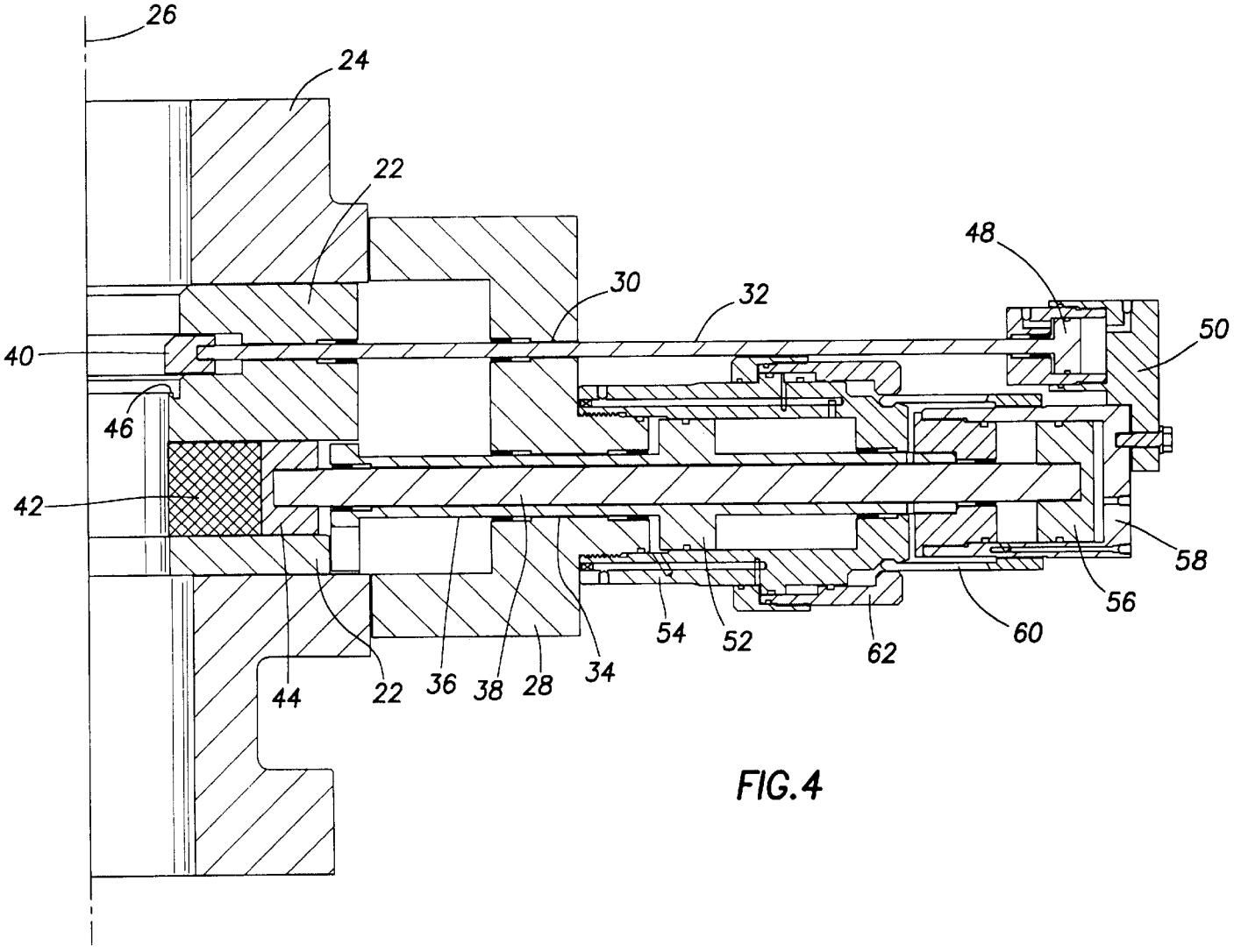
FIG. 4 is another side section view of the BOP of FIG. 2 with a cartridge latch actuated, but without the cartridge in place.

The BOP 18 is shown in detail in FIGS. 2, 3, and 4 and is a modified version of the BOP disclosed and claimed in U.S. Pat. No. 5,590,867 to Van Winkle, and this patent is incorporated herein by reference. FIGS. 2–4 depict a preferred actuator for a blowout preventer, but other actuators may be used. A feature of the actuator depicted in FIGS. 2–4 is the coaxial rod described and claimed in the '867 patent.

The BOP 18, however, includes novel features which adapt the BOP to the present invention. The BOP includes a ram 22 within a housing 24 which defines an axial bore 26 to receive a tubular member, such as a pipe or coiled tubing. The ram 22 reciprocates within the housing, to open and shut the BOP as desired. Extending laterally of the housing 24 is a chamber 28 to provide the ram 22 with adequate lateral travel. The housing 24 provides a penetration 30 for access of a latch rod 32 and a penetration 34 for access of a ram piston rod 36 and an energizer piston rod 38. In the preferred embodiment shown in FIGS. 2–4, the energizer piston rod 38 is coaxial with the ram piston rod 36, although other arrangements for the rod 36 and 38 are acceptable within the scope and spirit of this invention.

Within the housing, 24 and slotted into the ram 22 is a cartridge latch 40 to latch the cartridge within the BOP. The cartridge latch 40 is attached to the end of the latch rod 32 within the housing 24. Also within the housing 24 and formed integrally with the ram 22 is an energizer 42. An energizer compressor 44 is in abutting contact with the energizer 42 and is coupled to the end of the energizer piston rod 38 within the housing 24.

The ram 22 includes a female helix with up-facing flange 46, which may be considered a female mating surface for a cartridge to be received within the housing. The up-facing flange 46 retains a cartridge half as a temporary integral part of the ram and provides minimal interference for the action of the energizer 42. The energizer 42 squeezes against the cartridge mounted on the face of the ram 22 to transmit force to a sealing element, such as a packer or slip element, that is a part of the cartridge.

The latch rod 32 coupled to the cartridge latch 40 is actuated by a latch piston 48 within a latch piston cylinder 50. The ram piston rod 36 is actuated by a ram piston 52 within a ram piston cylinder 54. The energizer piston rod 38 is actuated by an energizer piston 56 within an energizer cylinder 58. The ram piston rod 36 extends axially from both sides of the ram piston, with one end of the ram piston rod 36 connected to the ram 22 and the other end of the ram piston rod 36 connected to the energizer cylinder 58. The latch piston cylinder 50 is coupled to the energizer cylinder 58. Thus, when the ram piston 52 is actuated (i.e., moved to the left as seen in FIGS. 2–4), the energizer cylinder 58 and the latch piston cylinder 50 also move to the left as a unit. As a consequence, the cartridge latch 40, the energizer 42, and the ram 22 move together so that the cartridge latch 40 and the energizer 42 are properly position for their actuation as required and described below.

The mechanism just described provides a method for locating the ram 22 at a precise position to receive the cartridge, for actuating the latch 40 to retain or release the cartridge as desired, and an independent force for energizing the packer element in the cartridge. Since the reaction force from the energizer piston 56 on the energizer cylinder 58 tends to have a negative effect on the force locating the ram 22, thereby tending to misalign the ram 22 from its proper position within the housing for receiving and retaining the cartridge, a mechanical locking collet 60, retained by piston ring 62 assures that the ram with a cartridge remains in working position, regardless of opposing forces generated by the pistons 52 and 56.

FIG. 4 shows the actuator with the piston 52 driven to the left, relative to the BOP, and the piston 48, also driven to the left, to actuate the cartridge latch 40. However, the relative position of the piston 56 has not been changed from that of FIG. 3, thus the energizer 42 has not been actuated. Comparison of FIGS. 3 and 4 also illustrates the functioning of the collet 60. The flexible collet 60 mates with a detent 64 (FIG. 3) and is retained in place by the piston ring 62, (FIG. 4).

The preceding description of the BOP was provided in order to give an understanding of the structure of the BOP of this invention, as well as an understanding of the structure wherein the cartridge of this invention finds application. Now that the modified BOP has been described, the cartridge and its deployment can be more easily understood.

Figure 5A:
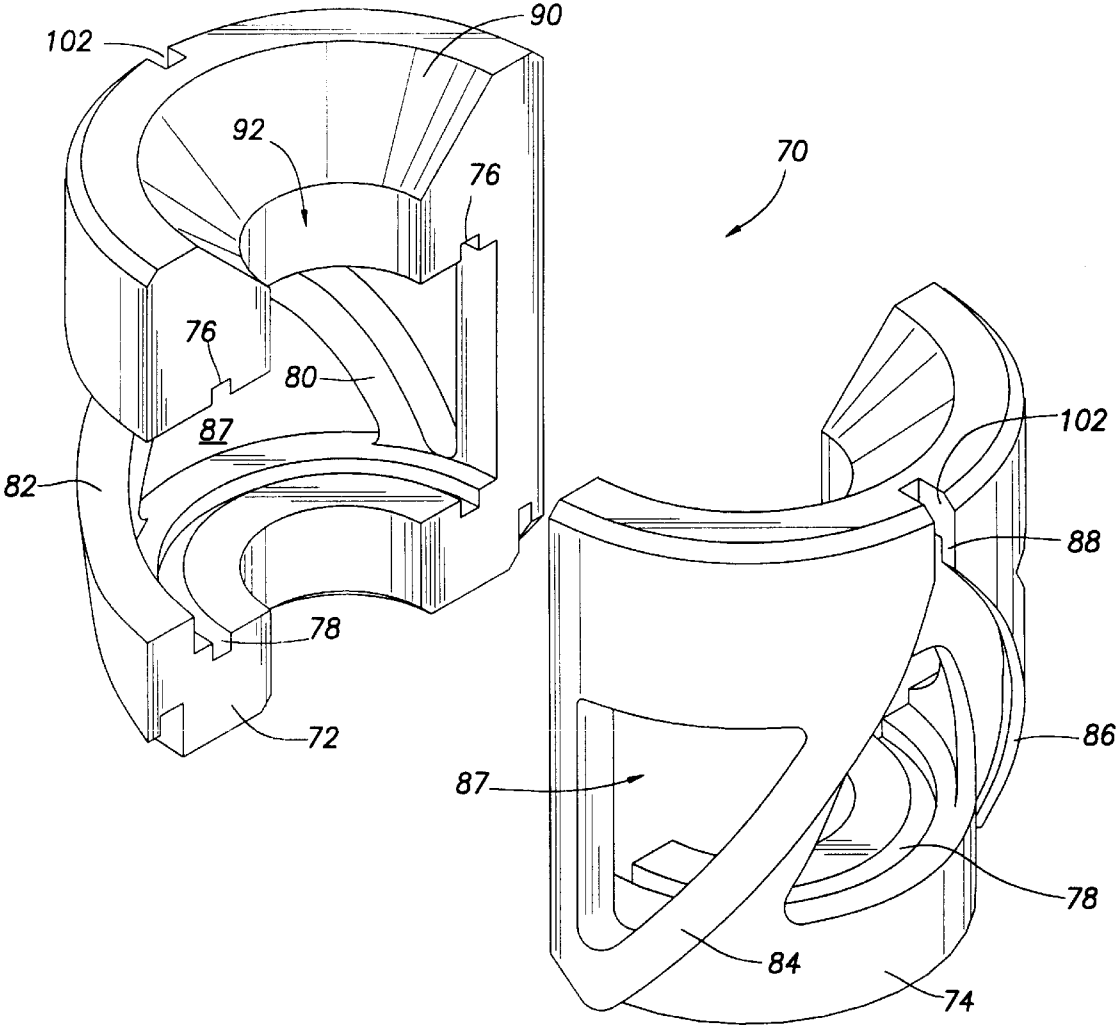
FIG. 5*a* is a perspective view of the support portion of a split cartridge of this invention, and without its packer element in place.
Figure 5B:
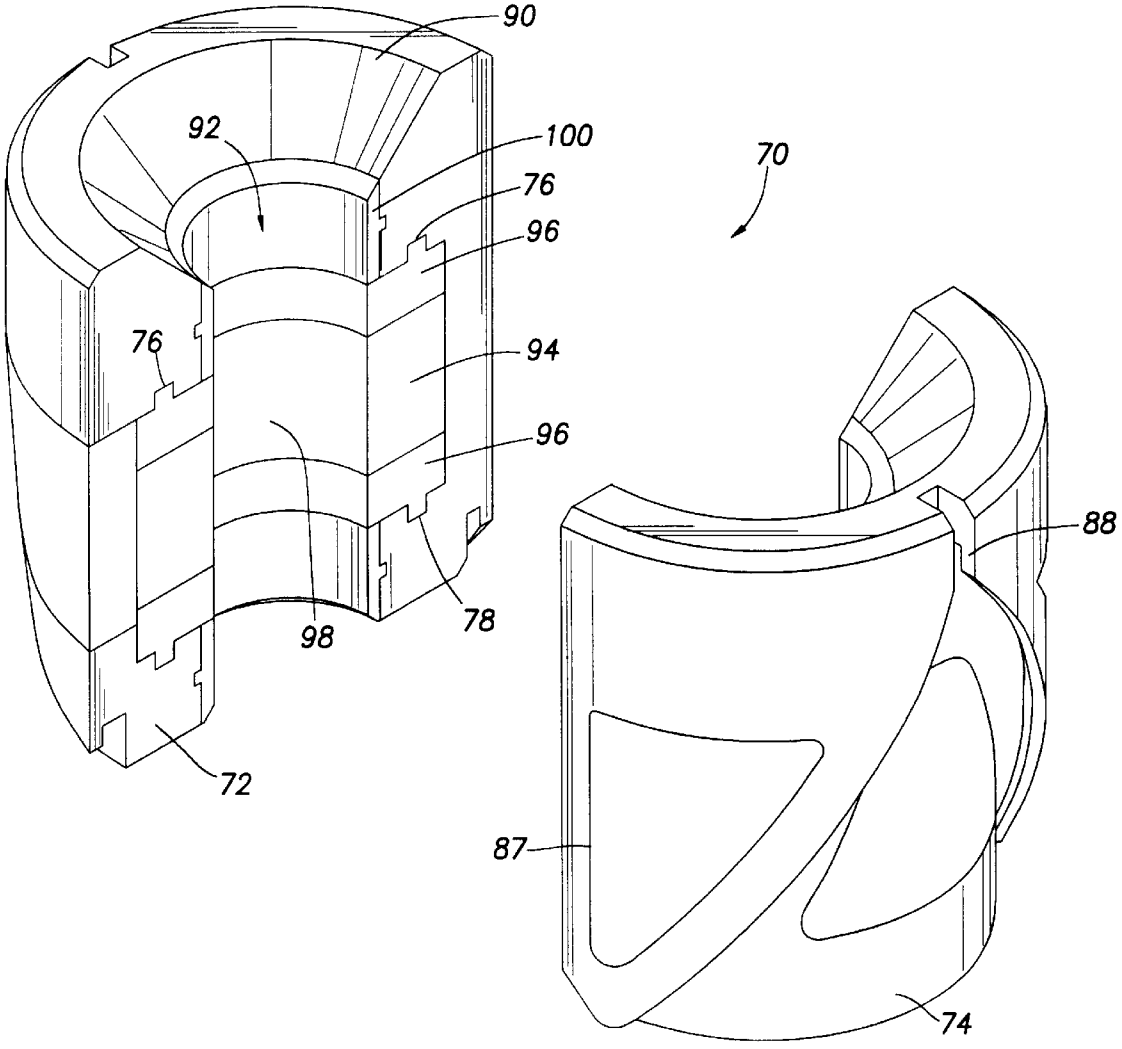

A cartridge 70 is shown in FIGS. 5*a*, 5*b*, and 5*c*. The cartridge is preferably made of brass or similar material that resists corrosion in a sea water environment. The cartridge may also be made of stainless steel with wear surfaces made of brass, as desired, or the cartridge may be formed of plastic, ceramic, or other suitable material. The cartridge 70 comprises a first half 72 and a second half 74 to provide access to a mating set of mounting grooves 76 and 78 which receive a mounting ring of a packer element. The cartridge half 72 includes a clockwise alignment ramp 80 (as viewed from the top) and a counter-clockwise alignment ramp 82 and the cartridge half 74 includes similar alignment ramps 84 and 86.

The alignment ramps define windows 87 in the cartridge halves which are filled with a elastomeric material. The elastomeric material acts as a pressure transfer medium to transfer pressure from the actuator and thus to the energizer to the packer element. The elastomeric material may also be cast to fill the windows in the cartridge halves, as well as the volume otherwise occupied by the packer element as described above. The cartridge is capable of being refurbished in either case, with or without the removable packer element.

Each of the ramps 80, 82, 84, and 86 forms a male helix with down-facing flange, most clearly seen with regard to ramp 86 and a male helix with down-facing flange 88. This down-facing flange 88 may be considered a male mating surface for the female up-facing flange 46 on the ram 22. The flange 88, and similar flanges on ramps 80, 82, and 84, engages the complementary up-facing flange 46 on the ram 22. As the flange on the cartridge and the flange on the ram engage, the cartridge 70 rotates to a proper orientation as it reaches its position opposite the ram 22. When rotated to match helixes, the mating flanges stop all further downward movement of the cartridge, relative to the ram, and retain the cartridge to the ram when the ram moves laterally away from the BOP vertical bore.

The cartridge 70 further includes a conical upper face 90 adapted to assist in the proper placement of a running or retrieving tool. At the bottom and the center of the upper face 90 is a bore 92 through which the running or retrieving tool is inserted.

FIG. 5*b* shows a cartridge 70 with a packer element 94 inserted in the mounting grooves 76 and 78 by rotating the packer element into place. As previously described, the windows 87 have been filled with an elastomeric material. The packer element 94 is also made of an elastomeric material, preferably an elastomeric mounting ring 96 and an elastomeric interior region 98. FIG. 5*b* also illustrates that the cartridge 70 may include brass inserts 100 for wear parts to reduce cost.

FIGS. 5*c* and 5*d* together show the juxtaposition of a cartridge 70 with a ram 22. As shown in FIGS. 5*a* and 5*d*, the down-facing flange 88 spirals in a first direction to a flow channel 102, and then in the other direction. The up-facing flange 46 in the ram similarly spirals in a helical path in one direction to a point 104, which is opposite the flow channel 102 when the cartridge is releasably mounted to the ram, and then the flange 46 spirals in the other direction. In this way, it makes no difference how the cartridge is oriented relative to the BOP when it is inserted into the housing, the ramps cooperate to rotate and align the cartridge properly and to stop any further downward movement of the cartridge.

FIGS. 6*a* through 6*e* depict a retrieving tool 110 for use on tubing and a sequence for retrieving an element which is to be replaced. Such an element, for example, may be a packer element 94 mounted in a cartridge 70. The cartridge is mounted to the ram 22 and aligned with an energizer 42. The retrieving tool 110 comprises a protective cylinder 112 which is divided by a center wall 114 into an upper cylinder 116 and a lower cylinder 118. Extending vertically through the length of the protective cylinder 112 is a hollow rod 120 and integral with the rod 120 is a piston 122 within the upper cylinder 116. Formed in the rod 120 above the piston 122 is a latch detent 124, which locks the cartridge within the retrieving tool for the ascent from the BOP to the surface, as will be explained below.

Figure 6A:
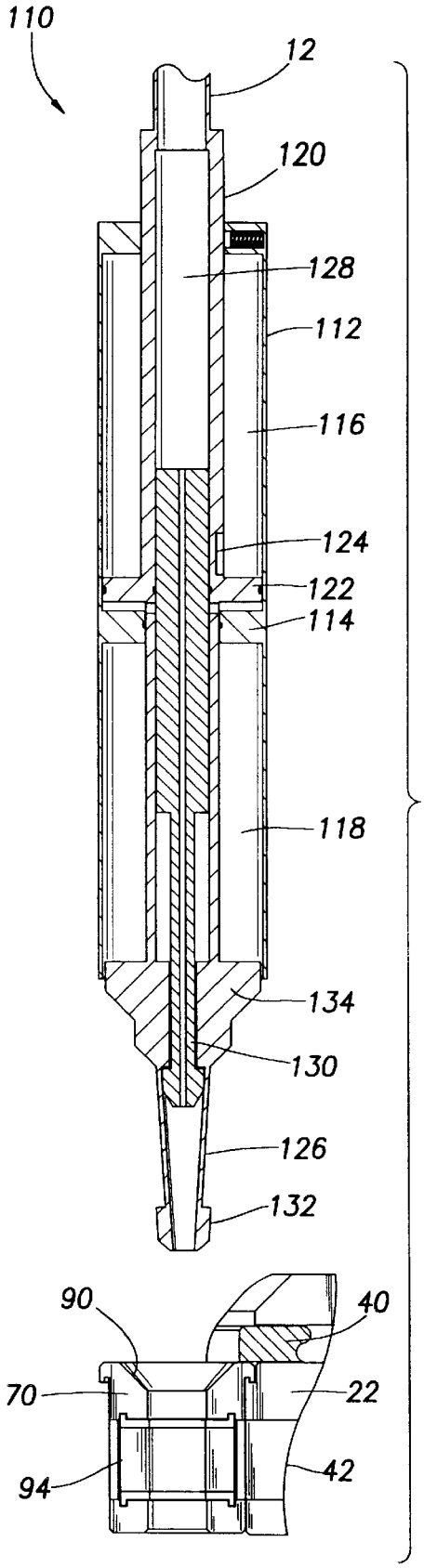
FIGS. 6*a* through 6*e* depict a retrieving tool and a preferred sequence of operations in retrieving a spent BOP packer or slip element where the retrieving tool is run on a pressure conduit such as coiled tubing or drill pipe.

The hollow rod 120 is joined to the umbilical 12, which in the embodiment of FIGS. 6*a*–6*e* is coiled tubing. The umbilical 12 may also comprise wireline, as shown in FIGS. 8*a* through 8*e* and described below. At the bottom end of the rod 120 is a collet 126 which is shown in FIG. 6*a* in its relaxed state. The hollow rod 120 defines a bore 128 therethrough and within the bore is an expander 130. As the expander slides downward within the bore, it spreads the collet 126 to expand a set of fingers 132 to grasp the cartridge 70, which includes a packer 94.

Figure 6B:
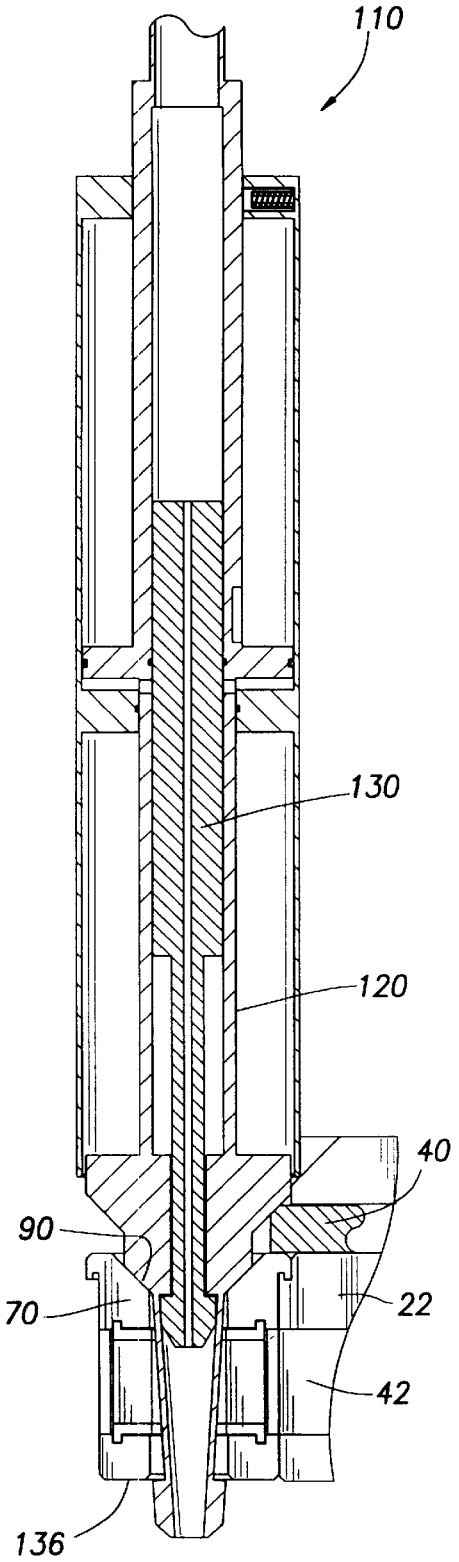

Also on the rod 120 and extending below the bottom of the lower cylinder 118 is a conical block 134 which mates up with the conical surface 90 of the cartridge. This is shown in FIG. 6*b*, in which the retrieving tool has been inserted in the cartridge 70. None of the components which make up the retrieving tool have changed position relative to the tool at the stage of FIG. 6*b* in retrieving a cartridge. Note that the fingers 132 at the bottom of the collet 126 now extend below a bottom surface 136 of the cartridge 70.

Figure 6C:
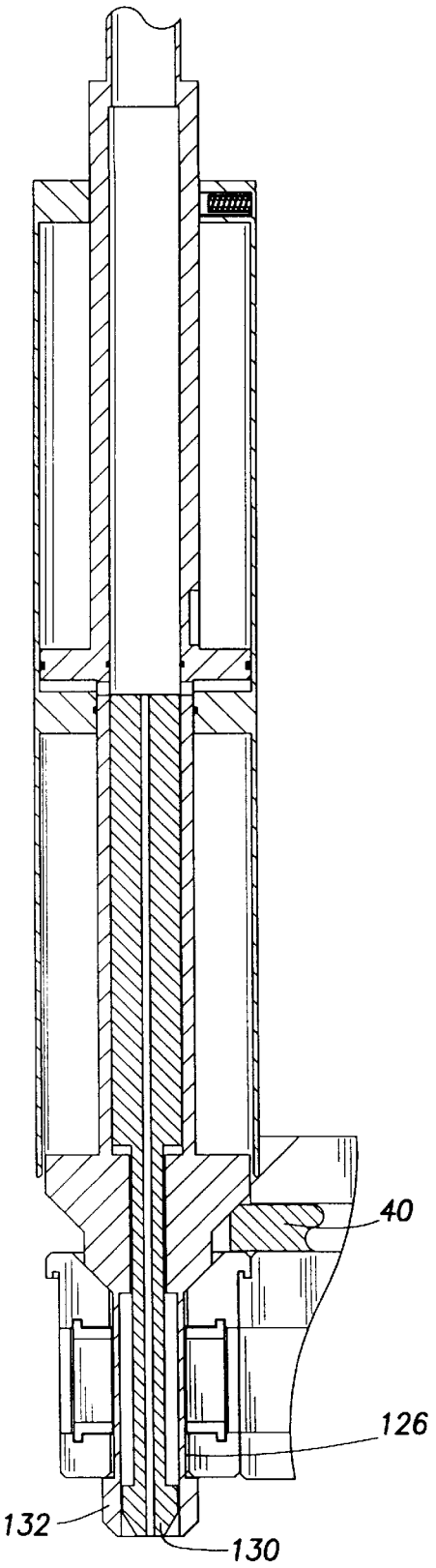

Next, as shown in FIG. 6*c*, the expander 130 is driven down into the collet 126 by hydraulic pressure in the bore 128 from the coiled tubing which is the umbilical 12, thereby spreading the fingers 132 to grasp the bottom of the cartridge. The collet 126 now fills substantially all of the bore 92 of the cartridge. Also, at this point, the cartridge lock 40 still retains the cartridge in place.

Figure 6D:
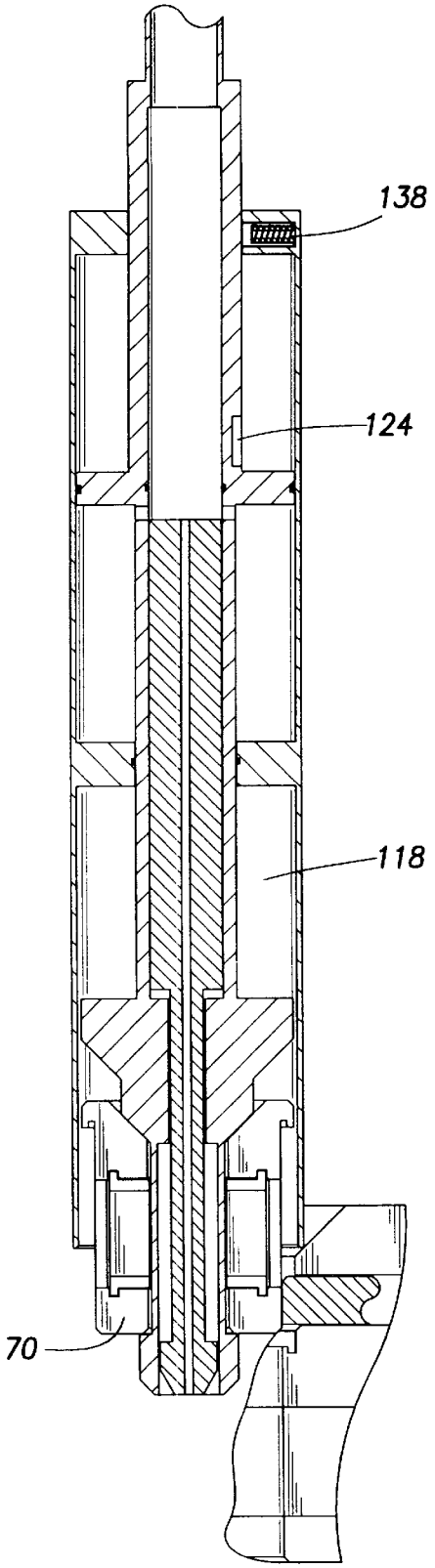
Figure 6E:
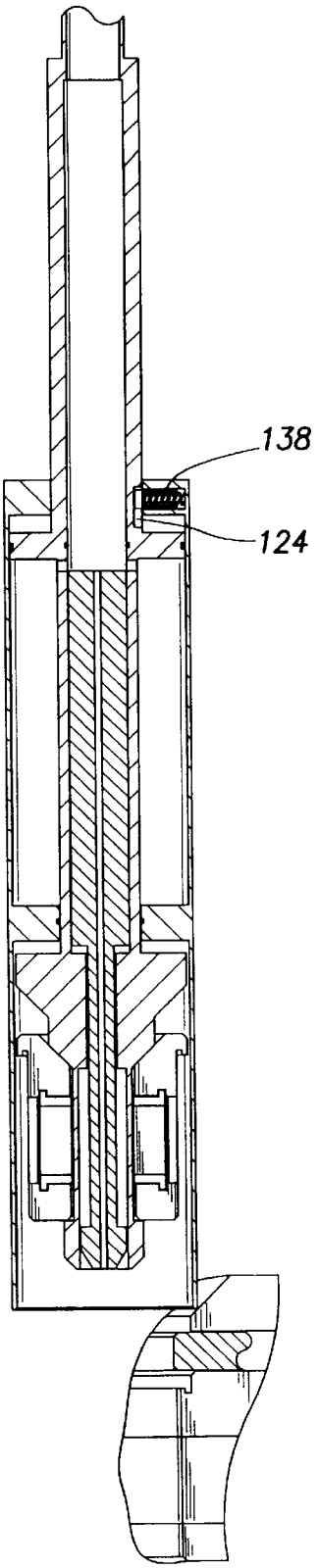

Next, as shown in FIG. 6*d*, the latch 40 is released and the cartridge 70 with the worn element is withdrawn into the lower cylinder 118 by actuating the piston 122 while the protective cylinder 112 remains in place relative to the BOP. As the cartridge is withdrawn fully into the cylinder 118, a spring loaded latch 138 extends into the latch detent 93 (FIG. 6*e*), thereby securing the rod 120 with cartridge attached inside the protective cylinder 112. The entire assembly is then withdrawn to the surface by the umbilical 12.

FIGS. 7*a* through 7*e* depict a preferred running tool 140 and a sequence of running a new element in place in a BOP. The running tool comprises an upper cylinder 142 and a lower cylinder 144, separated by a center wall 146. The upper cylinder 142 includes a fluid port 148. Within the upper cylinder 142 is a piston 150 coupled to a hollow rod 152 which passes through the center wall 146. Integral to the hollow rod within the lower cylinder 144 is a block 154, which is releasably secured to the lower cylinder by a shear pin 156. The block 154 includes a conical lower face 158 which mates with the upper conical face 90 of the cartridge 70.

Integral to the block 154 and therefore the hollow rod 152 is a collet 160 which terminates in a set of fingers 162. The fingers 162 abut against and retain the bottom 136 of the cartridge 70. The collet 160 is held apart by an expander 164 in a manner similar to the expander in the retrieving tool previously described.

The block 154 includes a transverse slot 170 which is loosely fitted with a locking dog 172. The locking dog 172 fits into a detent 174 to releasably retain the block 154 (and therefor the collet 160) in position relative to the expander 164.

Figure 7A:
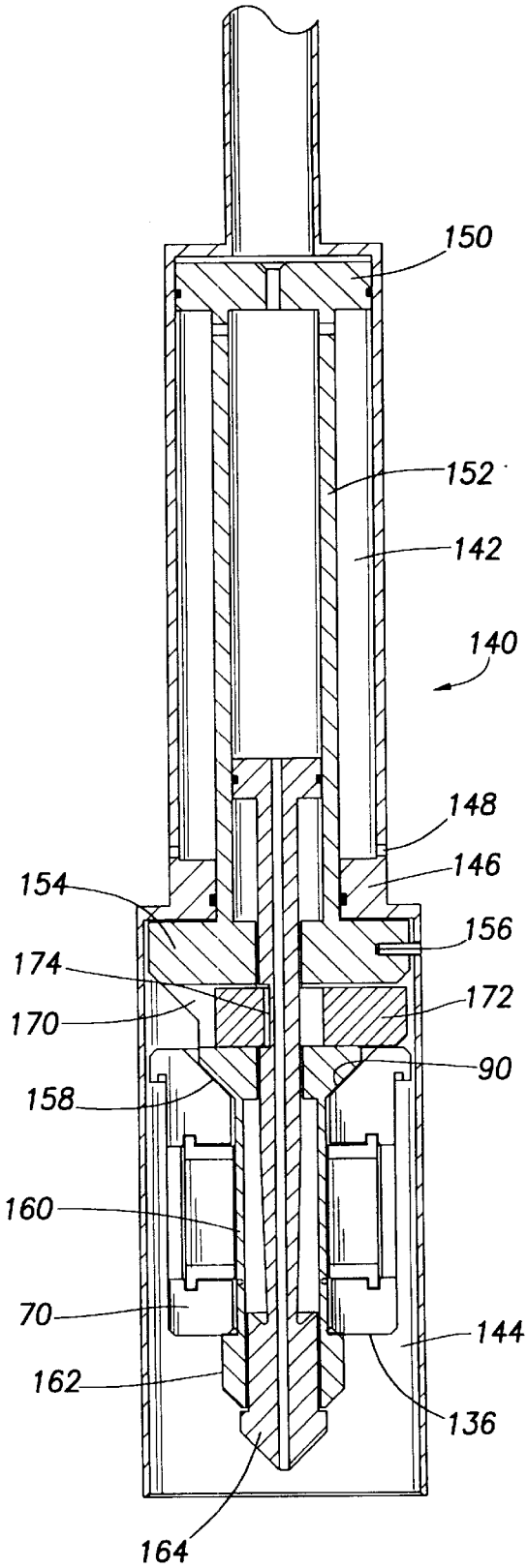
Figure 7B:
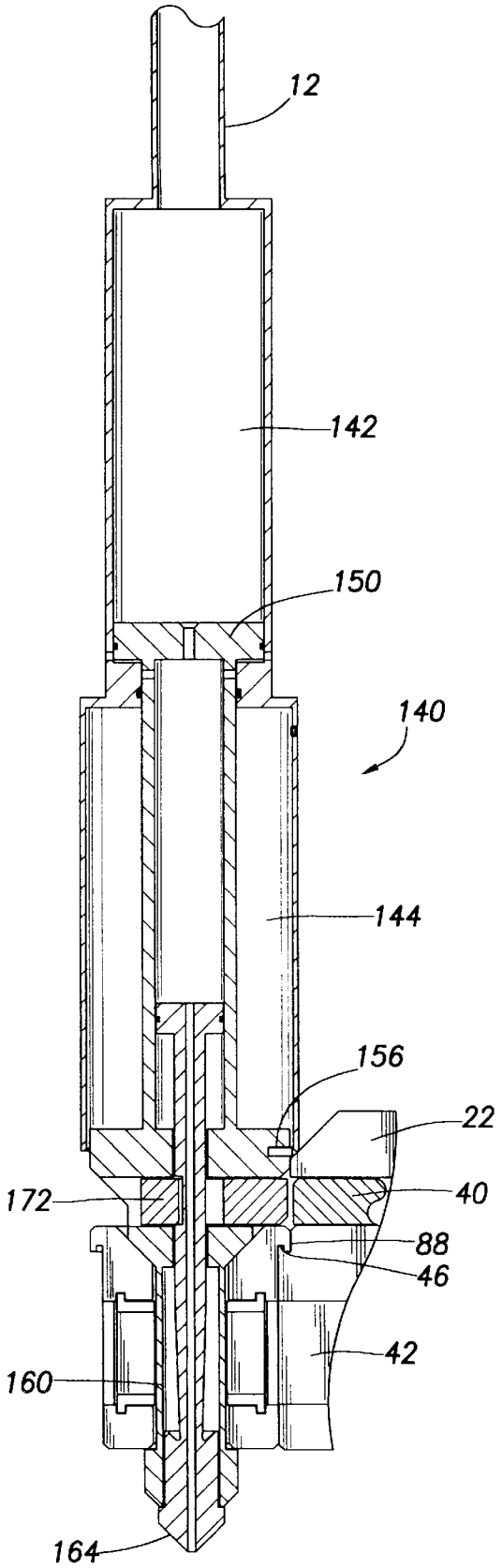

FIG. 7*b* depicts the running tool 140 in place adjacent a ram 22 with the cartridge 70 run into the BOP. Note at this point that the ram 22 has been run in (to the left as shown in FIGS. 2–4) but neither the latch 40 nor the energizer 42 has been actuated. This positions the up-facing flange 46 on the face of the ram to receive the down-facing flange 88 on the cartridge so that the cartridge is properly rotated into place and located in the desired vertical position on the ram, and restrained from all further downward movement. The shear pin 156 has been broken, permitting the cartridge to be run out of the lower cylinder 144. This is done by driving the piston 150 downward within the upper cylinder 142 by hydraulic pressure in the coiled tubing which is the umbilical 12. Note also that the locking dog 172 causes the collet and the expander to move together as a unit. The locking dog 172 prevents relative movement between the expander 164 and collet 160. Therefore the cartridge can only be released from the running tool when the locking dog 172 is shifted to the left by actuation of the BOP's latch 40. The latch 40 can only be actuated when the cartridge is in it proper operational location.

Figure 7C:
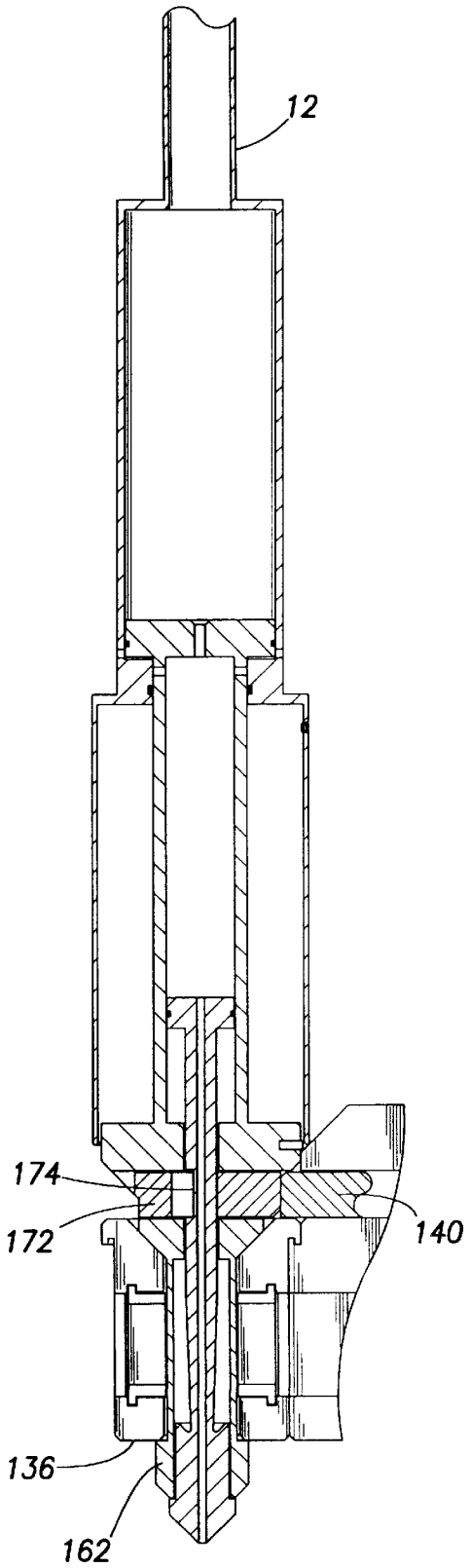

Next, as shown in FIG. 7*c,* the cartridge latch 40 is driven out, releasing the locking dog 172 from the detent 174. At this point, the expander is free to move relative to the collet. However, an upward force exerted on the umbilical 12 would not result in movement of the running tool or any of its components since the latch 40 holds the cartridge in place in the BOP housing, and the fingers 162 still engage the bottom 136 of the cartridge.

In FIG. 7*d,* the expander 164 is driven down so that the expander drops below the level of the fingers 162, allowing them to collapse. This frees the collet from the bottom surface of the cartridge and the running tool may now be removed from the BOP, leaving the cartridge in place in the BOP.

Finally, as shown in FIG. 7*e,* the entire running tool is withdrawn from the BOP, thereby leaving the new cartridge and packer element installed.

FIGS. 8*a* through 8*e* depict a retrieving tool 180 of this invention which may be deployed on an umbilical 12 which, in this embodiment, is a wireline. In this embodiment, the retrieving tool 180 comprises a cylinder 182, which is divided into an upper chamber 184 and a lower chamber 186, separated by a dividing wall 188. Within the upper chamber 182 is a sliding cylinder 190, which encloses a hammer 192.

FIG. 8*a* shows the retrieving tool 180 as it is poised to retrieve a cartridge 70 held in abutting contact with a ram 22. FIG. 8*b* then shows the retrieving tool 180 after is has been inserted into the cartridge 70. Further lowering of the wireline umbilical 12 lowers the hammer 192 against the top of the expander 130, driving the expander down so that it spreads the fingers 132, thereby engaging the bottom 136 of the cartridge 70. The cartridge latch 40 is then released, and the cartridge is freed so that can be extracted from the BOP. As the umbilical 12 is raised, it lifts the sliding cylinder 190, which contacts a flange 194 of the sliding cylinder. The sliding cylinder also includes a flange 196 at the bottom of the cylinder 190, which contacts a flange 198 which is coupled to the collet 126. Since the collet 126 has now engaged the bottom of the cartridge through the use of the fingers 132, the cartridge is then lifted free of the BOP, as shown in FIG. 8*e.*

FIGS. 9*a* through 9*e* depict a running tool 200 and a sequence of operations of running a cartridge into a BOP using a wireline umbilical 12. The running tool 200 comprises a cylinder 202 including an upper chamber 204 and a lower chamber 206. The lower chamber 206 surrounds the cartridge 70 being run into the BOP, and is open to the sea. Attached to the umbilical 12 is a hammer 208, which rides within a sliding cylinder 210. The bottom of the sliding cylinder 210 rests against an upper stem 212 of an expander 214, which is coaxial with a collet 216. The collet 216 abuts the bottom of the cartridge 70 and holds the cartridge within the tool.

As shown in FIG. 9*b,* when the cartridge 70 is properly rotated into place against the ram 22, further lowering of the umbilical 12 drops the hammer 208 against the bottom of the sliding cylinder 210. The upper stem 212 of the expander 214 does not yet move, since the collet and expander are prevented from relative movement by the dog. Then, in FIG. 9*c,* the latch is actuated, moving the dog aside and freeing the expander to move down relative to the collet. Also as shown in FIG. 9*c,* the hammer is then raised, but the cartridge is latched in place in the BOP by the latch. The hammer is then dropped in FIG. 9*d,* driving the expander down and releasing the collet from the cartridge. The tool is then free to be removed from the BOP and shown in FIG. 9*e,* leaving the cartridge in place in the BOP.

Figure 10:
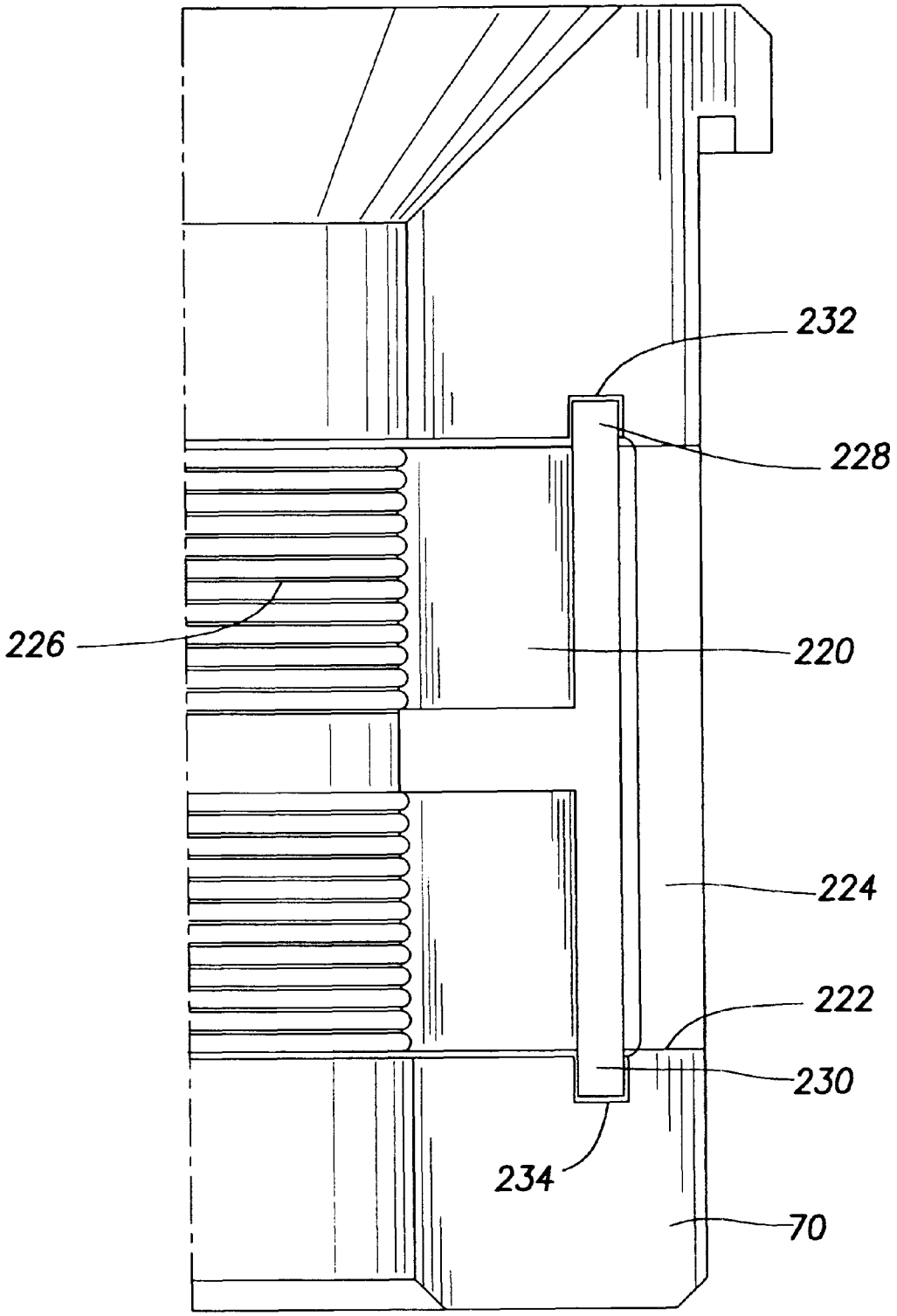
FIG. 10 is a side section view of a cartridge including a slip insert to grip the pipe in the BOP.

As previously described, the present invention is not limited to replacing a packer with another packer of the same size. As shown in FIG. 10, the cartridge 70 may also retain a slip insert 220. The cartridge 70 includes a window 222 which is filled with an elastomeric material 224, which transmits pressure to the slip insert 220 to grasp a tubular member through the bore of the BOP with a set of ridges 226, a well-known feature of a slip insert. The slip insert 220 includes an upper mounting ring 228 and a lower mounting ring 230 which are rotatingly slid into mounting grooves 232 and 234, respectively.

Figure 11:
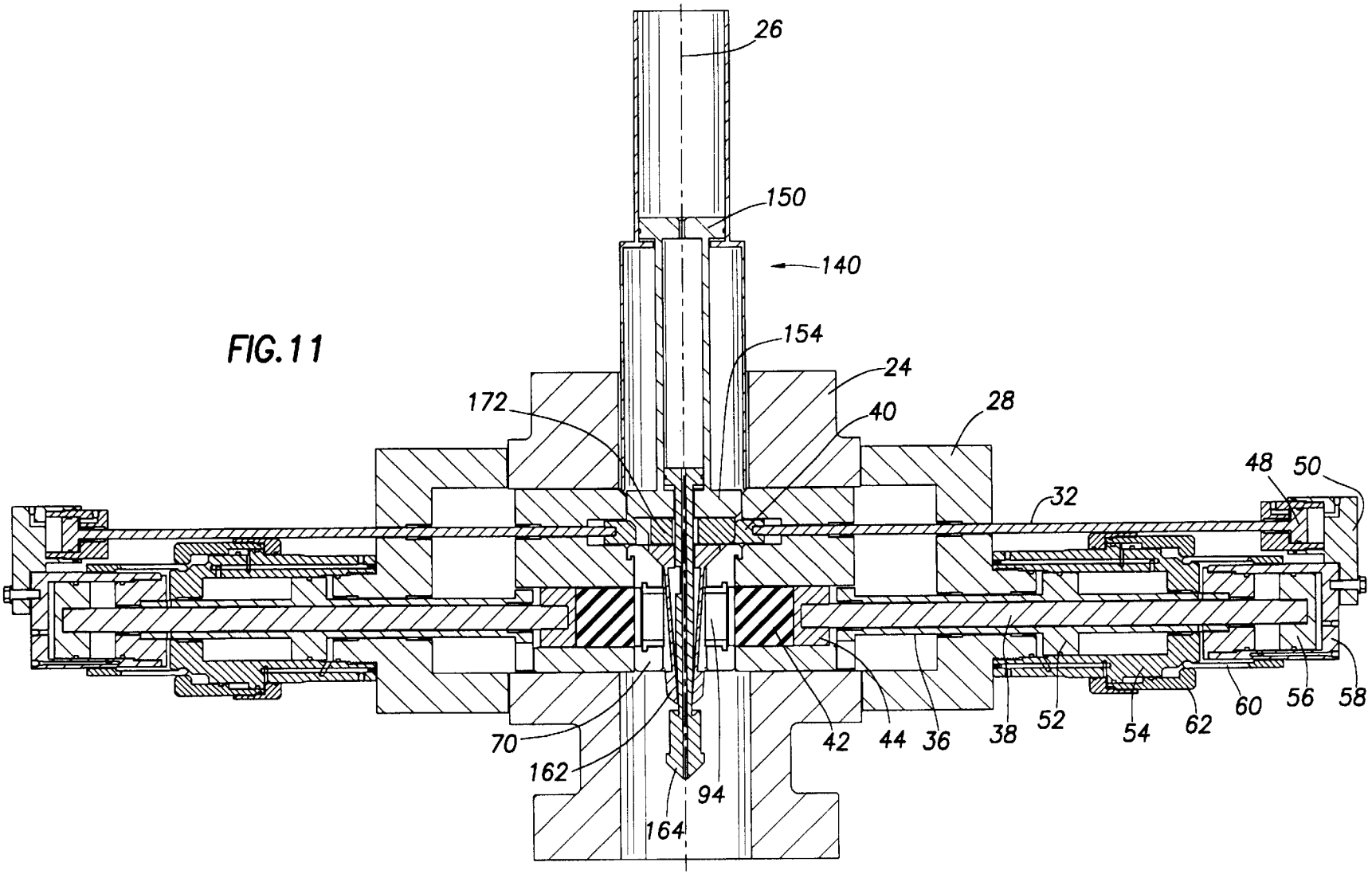
FIG. 11 is a side section view of a pair of rams and actuators with a running tool and cartridge.

Finally, FIG. 11 depicts a running tool, for example, at a specific step in the running method to show the tool in place in a BOP having mirror image actuators on either side. Reference is made to the previous discussion for the structure and the sequence of operations.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A method of replacing a sealing element in an undersea blowout preventer comprising the steps of:

a. lowering a retrieving tool within a retrieving cylinder to an undersea blowout preventer;

b. removing a first cartridge carrying the sealing element from the blowout preventer into the retrieving cylinder by the retrieving tool;

c. mounting a replacement sealing element to a second cartridge;

d. mounting the second cartridge on a running tool within a running cylinder;

e. lowering the running cylinder with the second cartridge to the blowout preventer; and f. inserting the second cartridge into the blowout preventer.

2. The method of claim 1, further comprising the step of securing the cartridge in the running cylinder with a shearable pin prior to the step of lowering the running cylinder to the blowout preventer.

3. The method of claim 1, further comprising the step of securing the cartridge in the running cylinder with a slideable dog prior to the step of lowering the running cylinder to the blowout preventer.

4. The method of claim 1, further comprising the step of securing the retrieving tool to the retrieving cylinder after the step of removing the sealing element from the blowout preventer into the retrieving cylinder.

5. The method of claim 1, further comprising step of engaging a helical flange on a ram in the blowout preventer with a helical flange on the cartridge to rotationally align the cartridge with the ram.

6. The method of claim 1, wherein the steps of lowering a retrieving tool and lowering a running tool are performed using coiled tubing.

7. The method of claim 1, wherein the steps of lowering a retrieving tool and lowering a running tool are performed using wire line.

8. The method of claim 1, wherein the steps of lowering a retrieving tool and lowering a running tool are performed using drill pipe.

9. A system for replacing a sealing element in a blowout preventer on the ocean floor comprising:

a. a retrieving tool for retrieving a first sealing element from the blowout preventer;

b. a running tool for running a new sealing element to the blowout preventer;

c. a first cartridge for retaining the first sealing element;

d. a second cartridge for retaining the new sealing element; and e. a cartridge latch for alternately retaining the first cartridge and the second within the blowout preventer.

10. The system of claim 9, wherein the first cartridge is split into substantially symmetrical halves along a vertical plane and the second cartridge is split into substantially symmetrical halves along a vertical plane.

11. The system of claim 10, wherein the blowout preventer includes a ram with a ram face defining a female helix with an up-facing flange, and wherein each of the first and second cartridges defines a male helix with a down-facing flange engageable with the down-facing flange.

12. The system of claim 10, wherein each of the cartridge halves is adapted to receive a packer element.

13. The system of claim 10, wherein each of the cartridge halves is adapted to receive a slip insert.

* * * * *